US010619805B2

(12) United States Patent
Olsson et al.

(10) Patent No.: US 10,619,805 B2
(45) Date of Patent: Apr. 14, 2020

(54) LIGHTING APPARATUS

(71) Applicant: DeepSea Power & Light, Inc., San Diego, CA (US)

(72) Inventors: Mark S. Olsson, La Jolla, CA (US); Jon E. Simmons, Poway, CA (US); Aaron J. Steiner, San Diego, CA (US); John I. Chew, Zephyr Cove, NV (US)

(73) Assignee: SEESCAN, INC., San Diego, CA (US)

( * ) Notice: Subject to any disclaimer, the term of this patent is extended or adjusted under 35 U.S.C. 154(b) by 0 days.

(21) Appl. No.: 15/859,191

(22) Filed: Dec. 29, 2017

(65) Prior Publication Data

US 2019/0003665 A1 Jan. 3, 2019

Related U.S. Application Data

(63) Continuation of application No. 14/804,201, filed on Jul. 20, 2015, now Pat. No. 9,863,590, which is a continuation of application No. 13/271,166, filed on Oct. 11, 2011, now Pat. No. 9,091,416.

(51) Int. Cl.

| | |
|---|---|
| ***F21S 8/02*** | (2006.01) |
| ***F21S 8/08*** | (2006.01) |
| ***F21V 7/00*** | (2006.01) |
| *G09F 13/02* | (2006.01) |
| *G09F 19/18* | (2006.01) |
| *F21W 121/00* | (2006.01) |
| *F21W 131/10* | (2006.01) |
| *F21Y 115/10* | (2016.01) |

(52) U.S. Cl.

CPC ..... *F21S 8/022* (2013.01); *F21S 8/081* (2013.01); *F21V 7/0008* (2013.01); *F21W 2121/00* (2013.01); *F21W 2131/10* (2013.01); *F21Y 2115/10* (2016.08); *G09F 13/02* (2013.01); *G09F 19/18* (2013.01)

(58) Field of Classification Search

CPC .... F21S 8/022; F21S 8/08; F21S 8/081; F21S 8/083; F21S 8/085

See application file for complete search history.

(56) References Cited

U.S. PATENT DOCUMENTS

| | | | |
|---|---|---|---|
| 4,999,060 | A | 3/1991 | Szekely et al. |
| 5,226,721 | A | 7/1993 | Stokes |
| 5,481,443 | A | 1/1996 | Wagner et al. |
| 5,718,506 | A | 2/1998 | Yeh |
| 5,791,768 | A | 8/1998 | Spiane, Jr. |
| 5,908,236 | A | 6/1999 | Lueken et al. |
| 5,921,663 | A | 7/1999 | Flammer |
| 6,033,093 | A | 3/2000 | Latsis et al. |
| 6,234,649 | B1 | 5/2001 | Katougi |
| 6,357,892 | B1 | 3/2002 | Beadle |

(Continued)

FOREIGN PATENT DOCUMENTS

CA 2479868 A1 * 3/2005 ..... F21S 8/081

*Primary Examiner* — Anh T Mai
*Assistant Examiner* — Nathaniel J Lee
(74) *Attorney, Agent, or Firm* — Steven C. Tietsworth, Esq.

(57) ABSTRACT

Environmental lighting assemblies are disclosed that may include a structural element, which may be a tubular J-shaped element or other shape or structure, as well as a driver module and an LED lighting engine assembly with a removable locking assembly for generating output light to streets, the ground, trees, or other surfaces, objects, or structures.

7 Claims, 41 Drawing Sheets

(56) References Cited

U.S. PATENT DOCUMENTS

| | | | | |
|---|---|---|---|---|
| 6,361,193 | B1 | 3/2002 | Gabrius et al. | |
| 6,422,717 | B1 | 7/2002 | Beadle | |
| 6,491,407 | B1 | 12/2002 | Beadle | |
| 6,612,720 | B1 | 9/2003 | Beadle | |
| 6,874,905 | B1 | 4/2005 | Beadle | |
| 7,021,787 | B1 | 4/2006 | Kuelbs | |
| 7,182,547 | B1 | 2/2007 | Leonhardt et al. | |
| 7,387,409 | B1 | 6/2008 | Beadle | |
| 9,863,590 | B2 * | 1/2018 | Olsson | F21S 8/022 |
| 2001/0007527 | A1 * | 7/2001 | Lammers | F21S 6/002 362/294 |
| 2002/0191391 | A1 | 12/2002 | Van Etten | |
| 2006/0193641 | A1 * | 8/2006 | Callahan | F21S 10/007 362/317 |
| 2008/0192476 | A1 * | 8/2008 | Hiratsuka | F21S 2/005 362/285 |
| 2008/0273333 | A1 * | 11/2008 | Berns | F21S 8/083 362/294 |
| 2008/0291674 | A1 * | 11/2008 | Welsh, Jr. | F21V 14/06 362/236 |
| 2009/0278474 | A1 | 11/2009 | Reed et al. | |

* cited by examiner

LIGHTING APPARATUS

CROSS-REFERENCE TO RELATED APPLICATIONS

This application is a continuation of and claims priority to co-pending U.S. Utility patent application Ser. No. 14/804,201, entitled PATHWAY LIGHTS, filed on Jul. 20, 2015, which is a continuation of and claims priority to U.S. Utility patent Ser. No. 13/271,166, now U.S. Pat. No. 9,091,416, entitled PATHWAY ILLUMINATION DEVICES, METHODS, AND SYSTEMS, filed on Oct. 11, 2011. The content of these applications is incorporated by reference herein in its entirety for all purposes.

FIELD

The present disclosure relates generally to devices and systems for environmental lighting of pathways, streets, corners, landscaping, homes, buildings, trees, and other areas. More specifically, but not exclusively, the disclosure is directed to pathway lights of variable configuration including a removable LED light engine unit.

BACKGROUND

Environmental lighting industry products are used in domestic, commercial, and public environments. Pathway lights are used to illuminate walkways, accent shrubs and trees, as well as to highlight corners and architectural features. Typical path light designs include a vertical column with a light affixed to the top, often with one or more reflectors to create a pool of light on the ground around the column or redirect the light toward a chosen target.

SUMMARY

The present disclosure relates generally to devices and systems for providing environmental lighting of pathways, streets, corners, landscaping, homes, buildings, trees, and other areas. More specifically, but not exclusively, the disclosure relates to environmental lighting devices in which a removable, lockable, LED light engine is fitted to one of a variety of lighting fixture structures shaped for different applications and appearances. The fixtures may be configured with various ornamental designs to provide a desirable aesthetic appearance.

For example, in one aspect, the disclosure relates to a path light in a cane or J-shaped fixture configuration in which the LED light engine is fitted in the short downward-facing end of the J-shape. In another aspect, the compound LED unit may be fitted in a shorter, upward-facing configuration.

In another aspect, the disclosure is directed to a path lighting apparatus for providing path or other directional environmental lighting. The apparatus may include, for example, a structural element and a light emitting diode (LED) light engine assembly disposed at least partially within a cavity formed in the structural element. The LED light engine assembly may be coupled to the structural element using a removable locking mechanism.

In another aspect, the disclosure related to methods for providing directional environmental lighting using the above-described path lighting apparatus and devices.

Various additional aspects, features, functions, and details are further described below in conjunction with the appended Drawings.

DETAILED DESCRIPTION OF EMBODIMENTS

Overview

Figure 1:
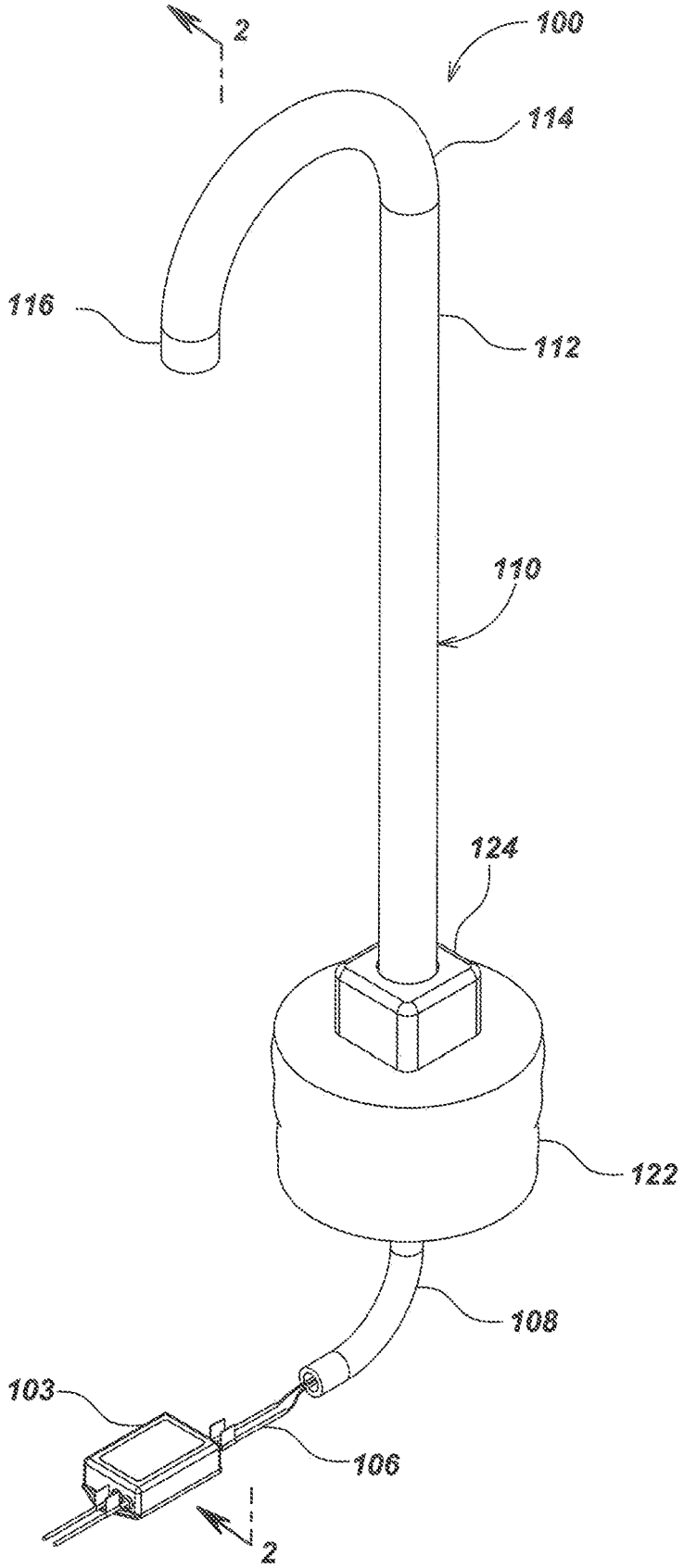
FIG. 1 is an isometric view of an embodiment of a pathway illumination system.

The present disclosure relates generally to devices and systems for providing environmental lighting of pathways, streets, corners, landscaping, homes, buildings, trees, and other areas. More specifically, but not exclusively, the disclosure relates to environmental lighting devices in which a removable, lockable, LED light engine is fitted to one of a variety of lighting fixture structures shaped for different applications and appearances. The fixtures may be configured with various ornamental designs to provide a desirable aesthetic appearance.

For example, in one aspect, the disclosure relates to a path light in a cane or J-shaped configuration in which the LED light engine is fitted in the short downward-facing end of the J-shape. In another aspect, the compound LED unit may be fitted in a shorter, upward-facing configuration.

In another aspect, the disclosure is directed to a path lighting apparatus for providing path or other directional environmental lighting. The apparatus may include, for example, a structural element and a light emitting diode (LED) light engine assembly disposed at least partially within a cavity formed in the structural element. The LED light engine assembly may be coupled to the structural element using a removable locking mechanism.

The structural element may, for example, be configured in a cane or J-shape. Alternately, the structural element may be configured in a square, triangle, helix, or other shape. The structural element may include multiple J-shapes which may each include one or more LED light engine assemblies.

The structural element may, for example, be a tubular element and the cavity formed in the structural element may be a hollow center of the tubular element. The tubular element may have a circular, oval, or otherwise rounded cross-section. The tubular element may have a square or rectangular cross-section. The tubular element may include a plurality of segments. The structural element may include tubular segments and non-tubular segments, such as solid segments. The lighting apparatus may further include a projection element for providing graphics, images, or other controlled or shaped light output.

The LED light engine may include, for example, a single LED element or a plurality of LED elements. The LED light engine may include a metal core printed circuit board. The LED light engine may include a plurality of LED elements disposed on the metal core printed circuit board. The metal core printed circuit may be made from copper and/or aluminum. The metal core printed circuit board may be made from other metals.

The locking mechanism may include, for example, a light fixture body, a threaded adjustment element, and a contact element. The threaded adjustment element may be a threaded cylinder element configured to move within a threaded channel of the light fixture body to position the contact element against the light fixture body. The light fixture body may include a shaped cavity having a gap for allowing the contact element to apply contact pressure to the light fixture body.

The shaped cavity may include, for example, a sloped floor surface. The threaded cylinder element may be a set screw and the contact element may be a ball bearing element configured to move along the sloped floor surface to apply contact pressure to the structural element responsive to tightening of the set screw within the light fixture body.

The shaped cavity may include, for example, a wedge surface. The contact element may be an angle-cut cylinder element configured to move along the wedge surface to apply contact pressure to the structural element responsive to tightening of the threaded cylinder within the light fixture body.

The light fixture body may, for example, be configured to provide a direct thermal path between the light engine and the structural element to dissipate heat generated by LED elements of the light engine.

Other embodiments may include shapes configured to direct light fully or partially downward, to the side, upward, and/or to particular features. Some configurations may include multiple lighting engines and/or structural configurations to direct light in multiple directions.

In another aspect, the same light engine assembly unit may be fitted to a short tubular assembly with an angled tip for highlighting landscaping features, display signs, trees, or other objects, structures, or features.

In another aspect, a projection element may be positioned adjacent or in proximity to the light engine assembly to generate an image, graphic, or other shaped light output.

In another aspect, the light engine assembly may include a dedicated driver or transformer unit providing power to the compound LED light engine from a power supply system, such as, for example, a 12-volt landscape power supply or other power supply.

Various additional aspect, details, features, and functions are described subsequently herein in conjunction with the appended drawings.

Example Embodiments

FIG. 1 illustrates an embodiment of a pathway illumination device 100 (also denoted herein as a "pathway light" or "path light" for brevity). Pathway illumination device 100 may include a tubular housing or support, such as J-shaped tubular support 110, which may comprise multiple tubular segments, such as segments 112, 114, and 116 as shown. Tubular segments may be finished as appropriate for the usage environment, such as by hot-dip galvanizing, powder coating, painting, or other surface finish processing to provide a desired finish. In other embodiments, one or more segments may be added or omitted relative to those shown in FIG. 1.

A flange plate (not shown in FIG. 1) may be attached near a base end of support 110, such as by welding, bolting, screwing, gluing, or otherwise attaching the base to the tubular support. The attachment point may be enclosed by a protective covering, such as cover 124 or by another covering material or mechanism. The protective covering may enclose the flange plate attachment point. The path light 100 may be mounted on or in the ground or other surface, such as in a concrete base 122.

Pathway illumination device 100 may be configured with a driver module, such as driver module 103, for providing and regulating electrical power to a light engine (not shown in FIG. 1), which may include one or more LED lighting elements and related components. Driver module 103 may optionally be disposed within tubular support 112 or at the base of tubular support 124, such as below cover 124. In an exemplary embodiment, electrical wires 106 may extend from the driver module 103 to the light engine (not shown in FIG. 1) through a conduit section 108, which may be made of a metallic material, plastics, such as Polyvinyl Chloride (PVC) or other protective materials. Additional light control elements, such as projection elements such as GOBOs, color filters, polarizers, focusing elements or diffusers, holographic elements, diffractive elements, prisms, and/or other light control elements (not shown in FIG. 1) may be positioned in proximity to the light engine to control and/or modify the light output.

Figure 2:
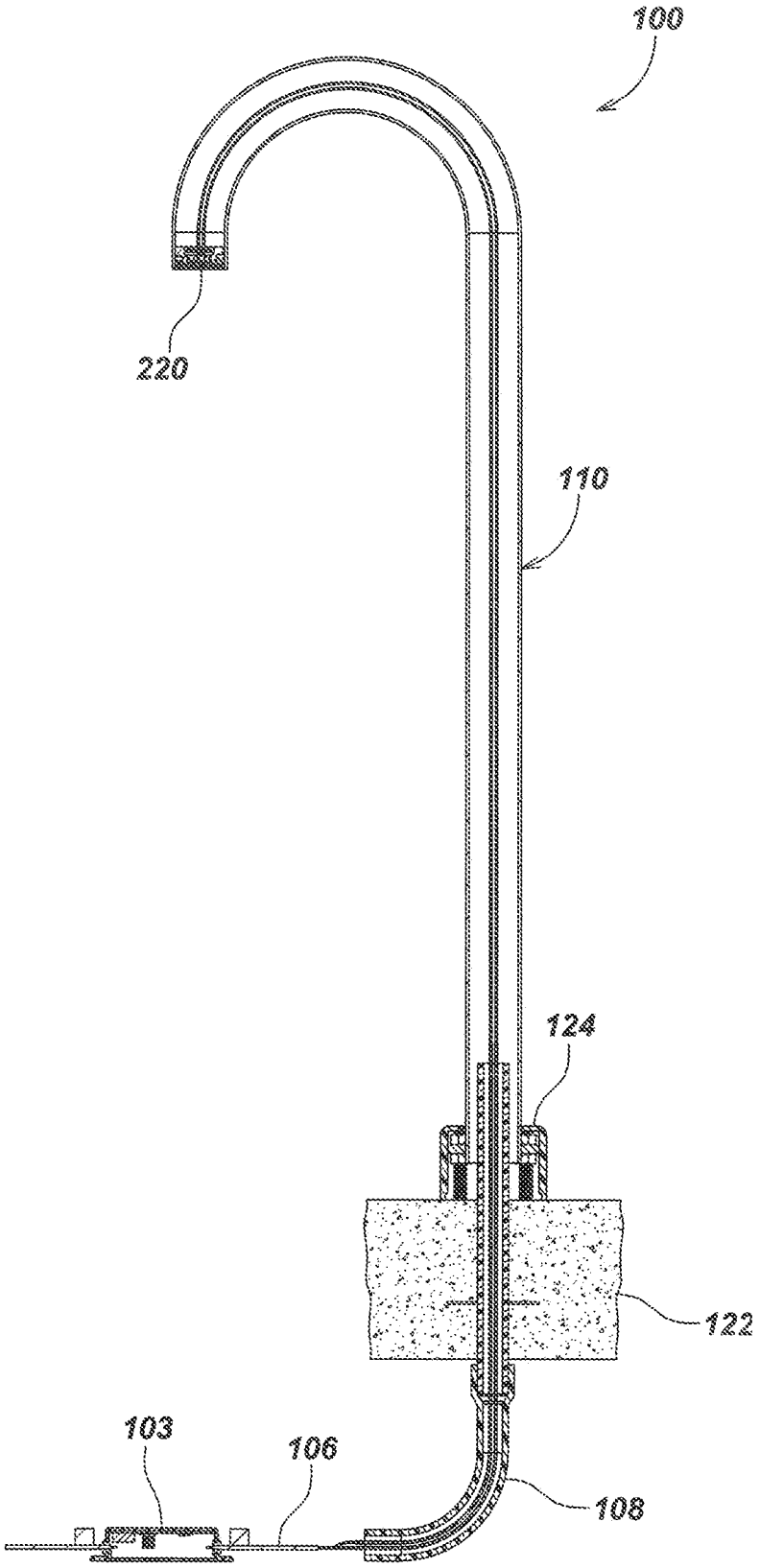
FIG. 2 is a sectioned side view of the pathway illumination system embodiment of FIG. 1, taken along line 2-2.

Turning to FIG. 2, a vertical section view illustrates additional details of the path light embodiment 100 of FIG. 1. For example, the light engine may comprise an LED light engine sub-assembly 220 which may be electrically connected to the driver unit 103 with wires 106. The LED light engine sub-assembly 220 may be constructed in accordance with the LED lighting embodiments described in U.S. patent application Ser. No. 12/844,759, filed Jul. 27, 2010, entitled SUBMERSIBLE LED LIGHT FIXTURE WITH MULTI-LAYER STACK FOR PRESSURE TRANSFER, the entire content of which is incorporated by reference herein.

Figure 3A:
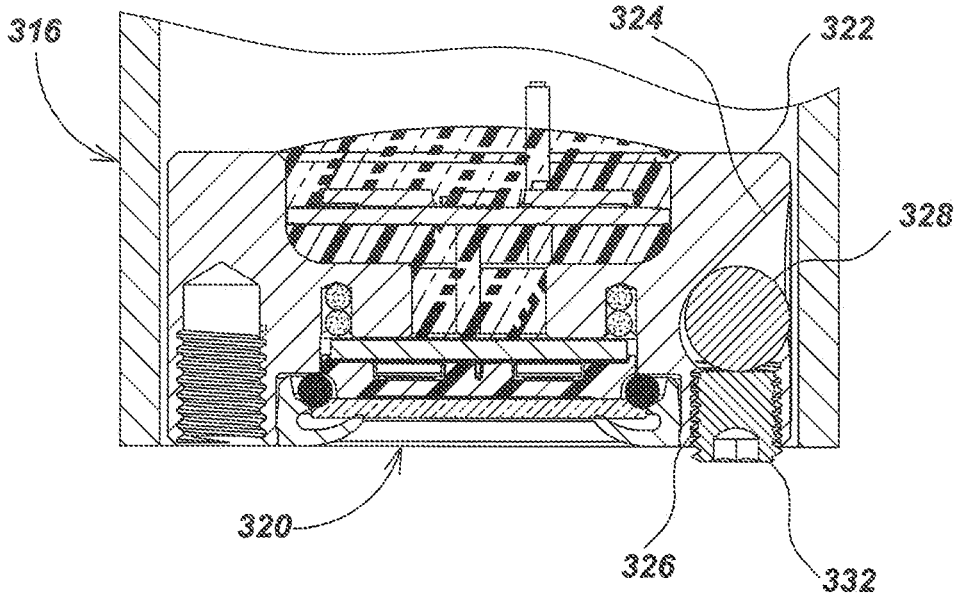
FIG. 3A is a detailed pre-installation section view of an embodiment of a light engine sub-assembly configured with a ball bearing.
Figure 3B:
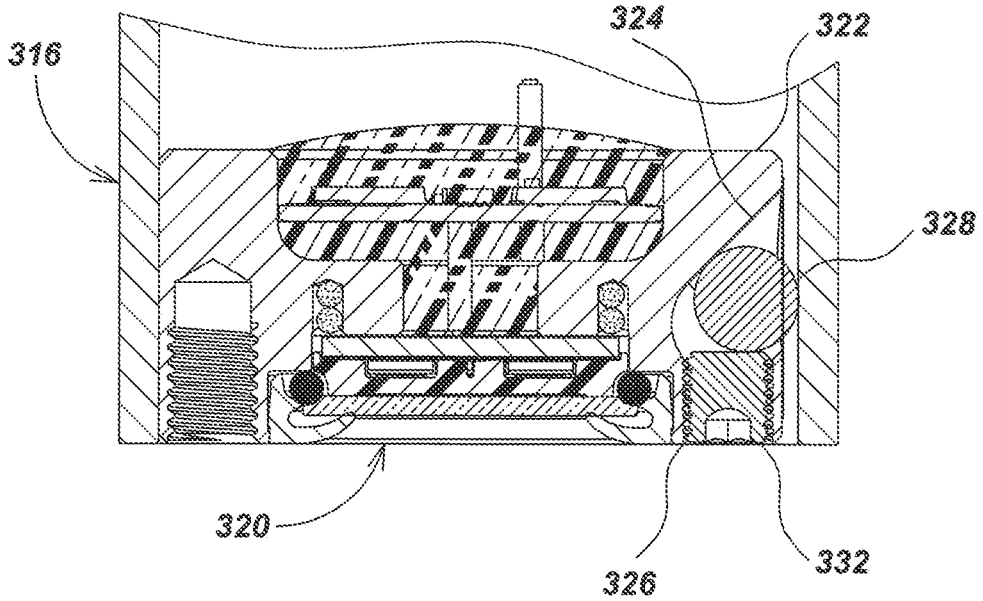
FIG. 3B is a detailed post-installation section view of an embodiment of a light engine sub-assembly configured with a ball bearing.

Turning to FIG. 3A and FIG. 3B, details of a removable locking mechanism for retaining a light engine sub-assembly 320, which may correspond with LED light engine sub-assembly 220 shown in FIG. 2, are illustrated. In an exemplary embodiment, light engine sub-assembly 320 may include one or more light emitting diodes (LEDs) and related electronic components, along with a locking mechanism which may include one or more ball bearings, such as ball bearing 328 as well as a threaded adjustment element, such as set screw 332, and a fixture body, such as light fixture body 322. LED light engine sub-assembly 320 may be removably attached to a section of a tubular support structure, such as tubular support segment 316, which may correspond with tubular segment 116 of FIG. 1 or may correspond with an end of another support structure configuration such as those described subsequently herein.

To lock the LED light engine sub-assembly 320 into the support structure, a light fixture body 322, which may include a threaded passage 326 formed into it into which a threaded adjustment element, such as set-screw 332, may be used. The threaded passage 326 may be formed with a shaped cavity 324 at one end, which may be cut into the side of light fixture body 322. A ball bearing or other curved, movable object, such as ball-bearing 328, may be fitted within the shaped cavity 324.

When the light engine 320 is initially inserted into tubular support segment 316, the light fixture body and/or tubular support segment inner wall may be configured so that there is a small gap between each side of the light fixture body 320 and the inner walls of the tubular support end segment 316. This gap is illustrated in FIG. 3A. After insertion of the light engine 320, the set-screw 332 may be tightened. The advance of set-screw 332 in its threaded passage 326 forces ball-bearing 328 to advance within cavity 324, and to protrude outward through the gap, contacting the right hand inner wall of tubular support end segment 316. Further tightening may then force the light fixture body 322 to wedge against the left wall of tubular support end segment 316, while the outer surface of ball-bearing 328 may be wedged against the right inner wall of tubular support end segment 316. The tightening of set-screw 332 may provide a friction grip on the light fixture body 322, holding it firmly in contact within the tubular support end segment 316, as shown in FIG. 3B. The physical contact between light fixture body 322 and tubular support 316 may provide a direct thermal path for carrying heat generated by LED elements away from LED light engine 320. Light fixture body 322 and/or tubular support segment 316 may include heat dissipation structures (not shown), such as fins, ribs, fans, and the like to facilitate heat dissipation from the light engine sub-assembly.

Figure 4:
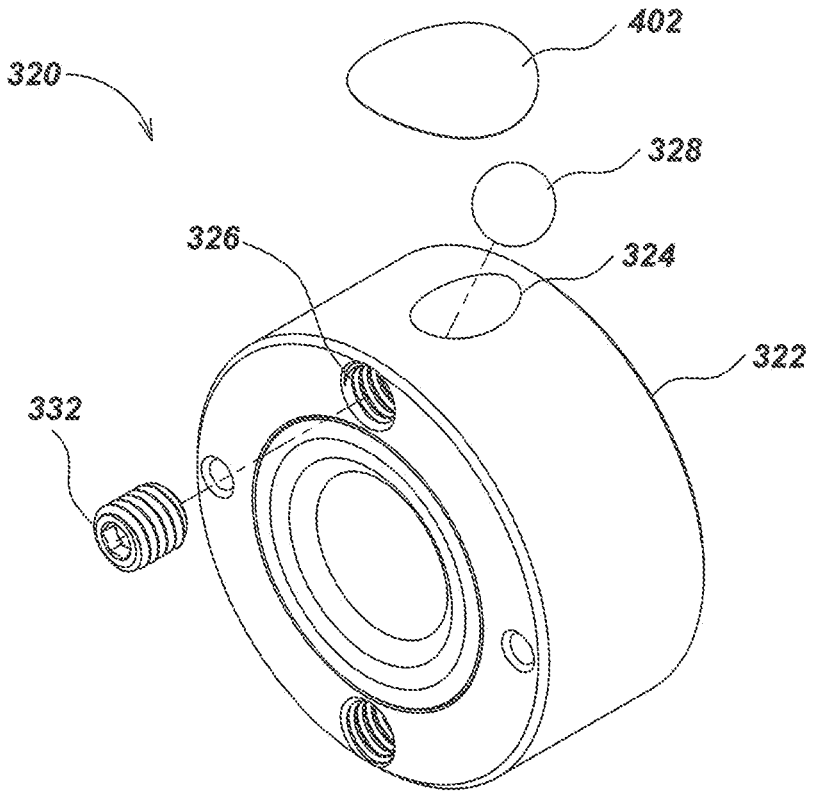
FIG. 4 is an isometric exploded view of the light engine sub-assembly illustrating a ball-bearing installation mechanism.

FIG. 4 illustrates additional details of the light engine 320 embodiment and corresponding light fixture body embodiment 322. Light fixture body 322, including threaded channel 326 ending in recess 324, retains the set-screw 332 threaded into channel 326. Ball bearing 328 may be inserted into the recess 324 and retained therein by a retention element, such as Kapton tape 402 as shown. When set-screw 332 is tightened, ball bearing 328 may be pressed outward by the sloped floor of the recess 324 to contact the inner wall of a tubular support segment (not shown). The Kapton tape 402 may be pressed against the wall of the tubular support end segment 108 (as shown in FIGS. 1 and 2) and a friction lock may be formed as described in the preceding examples corresponding to FIGS. 3A and 3B.

Figure 5A:
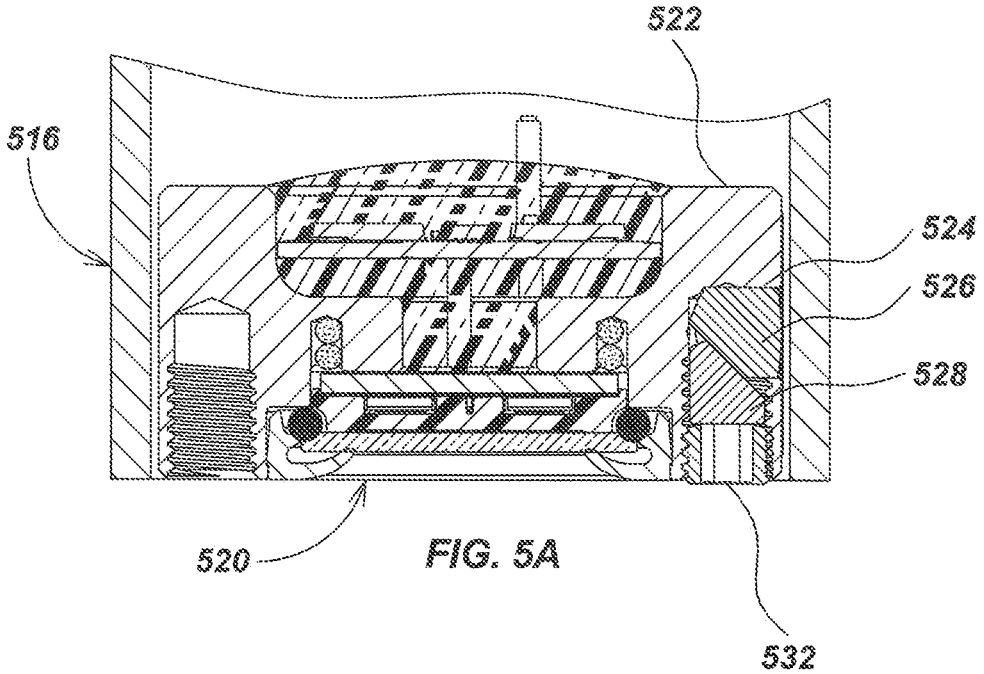
FIG. 5A is a detailed pre-installation section view of an embodiment of a light engine sub-assembly configured with cylinders.
Figure 5B:
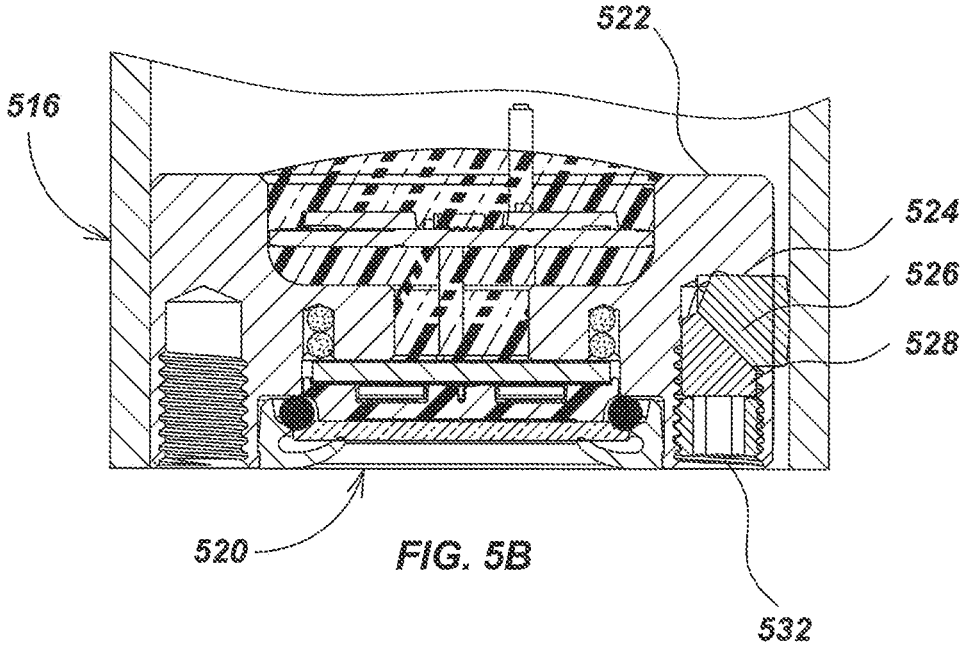
FIG. 5B is a detailed post-installation section view of an embodiment of a light engine sub-assembly configured with cylinders.

Turning to FIGS. 5A and 5B, details of an alternate embodiment of a locking mechanism for removably attaching a light engine sub-assembly 520, which may correspond with LED light engine sub-assembly 220 as shown in FIG. 2, are illustrated. In an exemplary embodiment, light engine sub-assembly 520 may include one or more light emitting diodes (LEDs) and related electronic components, along with a locking mechanism which may include one or more contact elements, such as cylinder 528, as well as a threaded adjustment element, such as set screw 532, and a fixture body, such as light fixture body 522. LED light engine sub-assembly 520 may be removably attached to a section of a tubular support structure, such as tubular support segment 516, which may correspond with tubular segment 116 of FIG. 1 or may correspond with an end of another support structure configuration such as those described subsequently herein.

In an exemplary embodiment, light engine sub-assembly 520 may be configured with one or more cylindrical elements, such as, for example, a first cylinder 528 and a second cylinder 526. First cylinder 528 may function as a contact element for being forced in contact with an inner wall of a tubular segment, either directly by pressure applied upon it, or by an intermediate element, such as second cylinder 526.

Light engine sub-assembly 520 may further include a light fixture body 522, which may be inserted fully or partially within an open ended tubular support element, such as segment 516. Light fixture body 522 may be formed with a channel 524 opening to the front of the light fixture body 522, and to the side of the light fixture body 522. The front section of channel 524 may be partially threaded at the front opening.

The first cylinder 528, which may be formed with a flat angled cut at one end, may be inserted into the front of channel 524. The other end of the first cylinder 528 may be cut flat and normal to the centerline axis. The second cylinder 526, which may be of similar construction to cylinder 528, may be inserted into the side of channel 524. The angled faces of the first cylinder 528 and the second cylinder 526 may be positioned to meet near a turn or apex of the channel, and the flat angle surfaces may slide against each other to facilitate locking or unlocking movements.

A threaded adjustment element, such as set-screw 532, may be threaded into the front section of channel 524. The set-screw 532, when tightened, moves against the flat end of the first cylinder 528, which may then drive against the angled face of the second cylinder 526 such that the second cylinder 526 moves outward along the side section of channel 524 and presses against the inner wall of the tubular support segment 516. Further tightening of the set-screw 532 may then cause the left side of the light fixture body 522 to wedge against the left inner wall of the tubular support 516, resulting in a friction lock which secures the light fixture 522 within the tubular support 516, similar to the locking action described previously with respect to FIGS. 3A and 3B. The physical contact between light fixture body 522 and tubular support 516 may provide a direct thermal path for carrying heat away from LED light engine sub-assembly 520. Light fixture body 522 and/or tubular support segment 516 may include heat dissipation structures (not shown), such as fins, ribs, fans, and the like to facilitate heat dissipation from the light engine sub-assembly.

Figure 6:
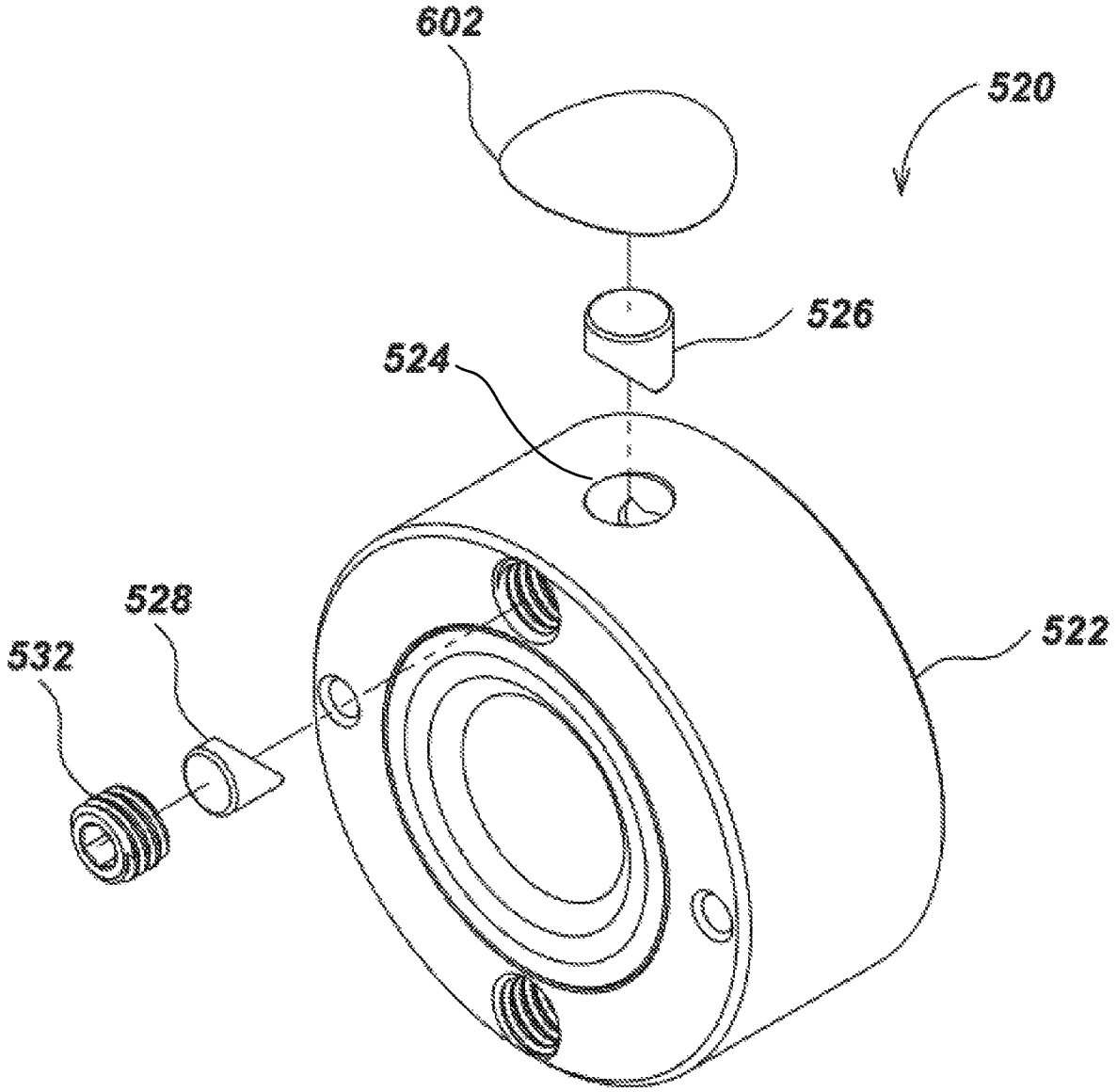
FIG. 6 is an isometric exploded view of the light engine fixture as illustrated in FIGS. 5A and 5B.

FIG. 6 illustrates additional details of the light engine embodiment 520 and corresponding light fixture embodiment 522 of FIGS. 5A and 5B. Light fixture body 522 may be formed with a partially threaded right-angle channel 524. The first cylinder 528, which may be formed with a flat angled cut at one end, may be inserted into the front portion of the right-angled channel 524 and retained by the set-screw 532. Set-screw 532 may be threaded into the channel 524 to provide adjustable locking. The second cylinder 526 may be inserted into the side portion of the right-angle channel 524 and may be retained by a retention mechanism, such as Kapton tape 602.

The angled faces of the first cylinder 528 and the second cylinder 526 may slidably contact against each other. When the set-screw 532 is tightened, the first cylinder 528 may be pressed against the second cylinder 526, with the two angled faces sliding against each other. The Kapton tape 602 may be pressed against the wall of the tubular support 516 (as shown in FIGS. 5A and 5B), and a friction lock may be formed as described in FIGS. 5A and 5B, thus fixing the light fixture 522 within the inner wall of the tubular support 516.

As with the examples corresponding to FIGS. 3B and 5B, the locking action may create a thermal contact path from an LED fitting of the light engine to the end segment 108 and/or tubular support 110 (see FIGS. 1 and 2), which may be made of steel or other conductive material, for providing thermal control for the lighting unit.

Figure 7:
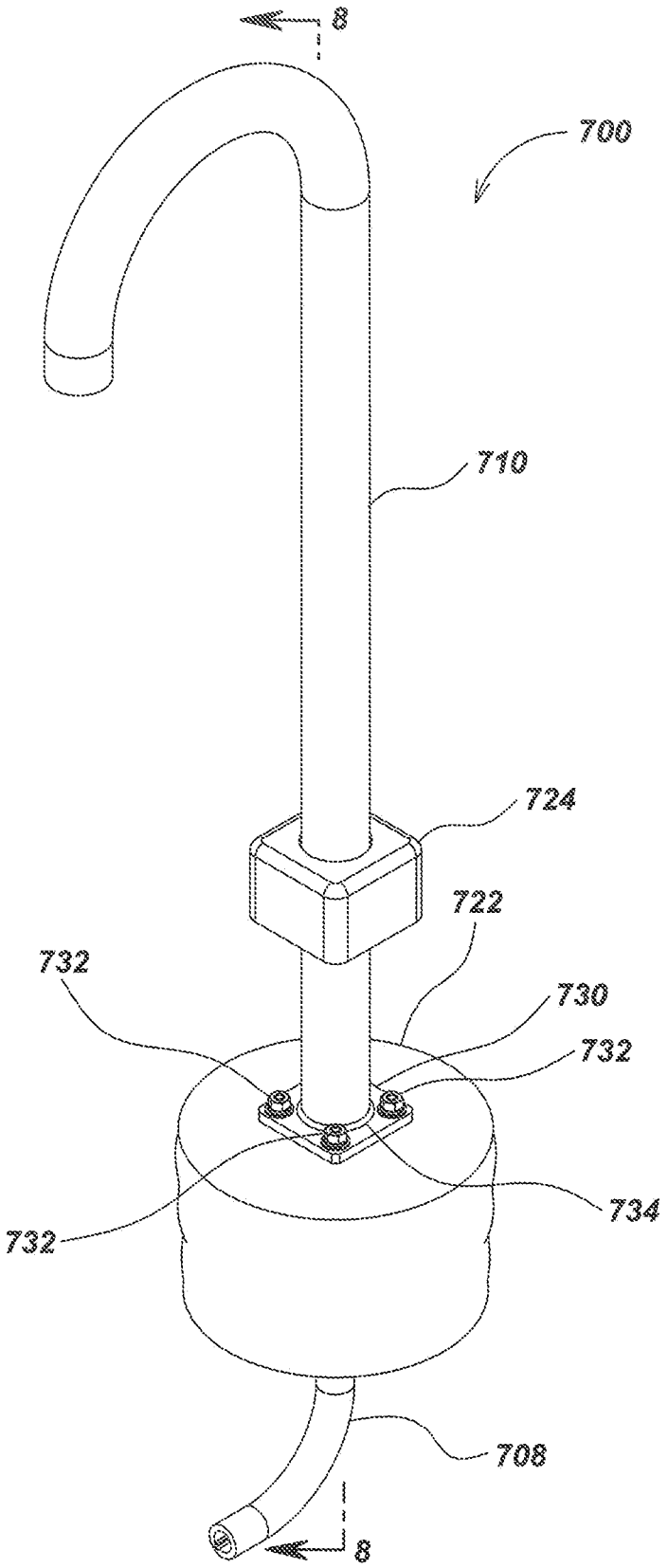
FIG. 7 is an isometric view of a path light installation embodiment.

Turning to FIG. 7, details of a cane or J-shaped path light embodiment 700 and associated mounting details are illustrated. In an exemplary embodiment, a J-configured tubular support 710, which may include at least one vertical tube segment, may be anchored on a concrete base 722. Tubular support 710 may correspond with tubular support 110 of FIGS. 1 and 2, and concrete base 722 may correspond with base 122 of FIGS. 1 and 2.

The base of the lower vertical tube segment of a tubular support 710 may be permanently attached to a flange plate 730 by at least one upper weld 734 or by another attachment mechanism. Protective cover 724, which may correspond with protective cover 124 of FIGS. 1 and 2, has been moved away from flange plate 730 to illustrate additional details. For example, flange plate 730 may be removably fixed to concrete path base 722 by one or more nuts, such as a set of four nuts 732 threaded onto one or more fasteners (not shown in FIG. 7) disposed in the concrete base 722. A conduit elbow 708 may lead connecting wires (not shown in FIG. 7), to a power circuit (not shown in FIG. 7). Conduit elbow 708, which may correspond with conduit section 108 of FIGS. 1 and 2, may be made of metal, plastic, such as Polyvinyl Chloride (PVC) or other appropriate materials.

Figure 8:
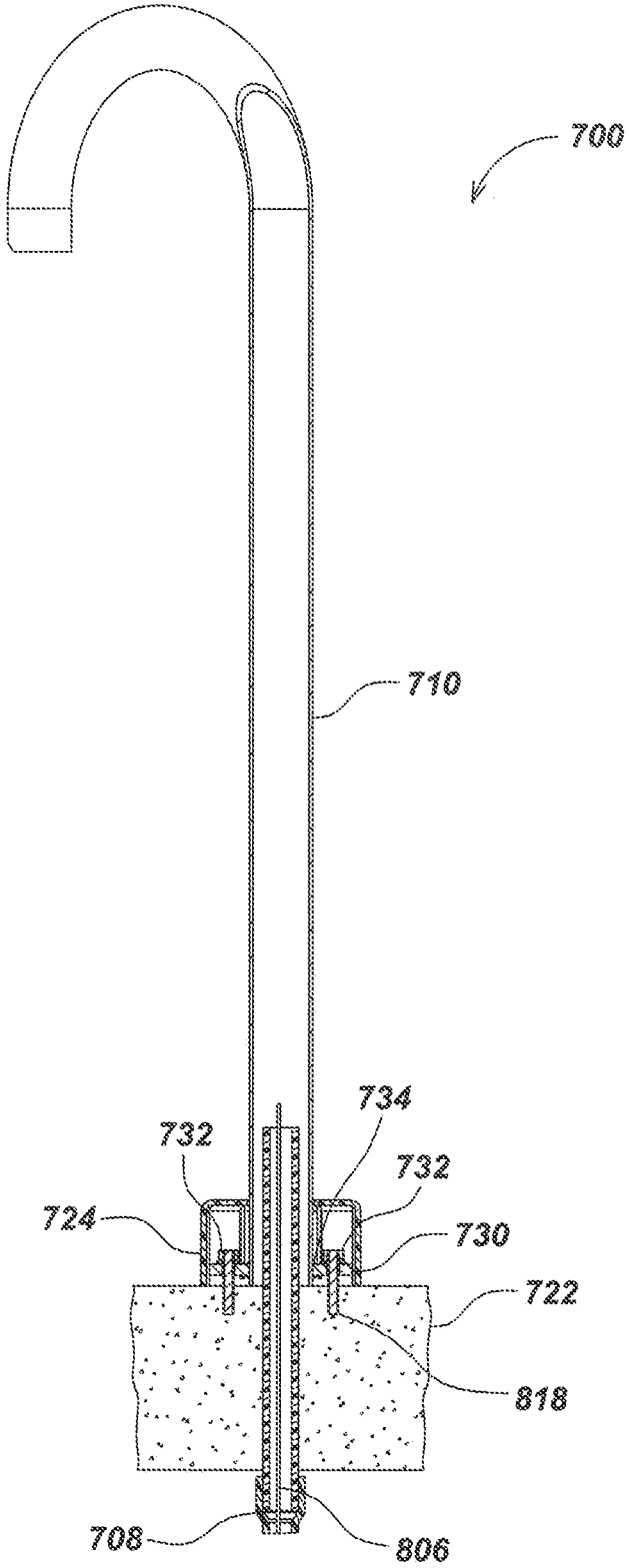
FIG. 8 is a side section view of the path light installation embodiment of FIG. 7, taken along line 8-8.

Turning to FIG. 8, a vertical section view illustrates additional details of the J-shaped path light embodiment 700 of FIG. 7. Wires 806, which may correspond to wires 106 as shown in FIGS. 1 and 2, may be disposed within tubular support and conduit elbow 708. In an exemplary embodiment, tubular support 710 may be welded to a flange plate 730, such that the tubular support may be anchored onto the concrete base 722. Nuts 732 may be threaded through flange plate 730 and onto one or more fasteners, such as a set of four upwardly-extending bolts 818, which may be disposed in the concrete base 722. Bolts 818 may be set into poured concrete, or otherwise fastened to concrete base 722.

Figure 9:
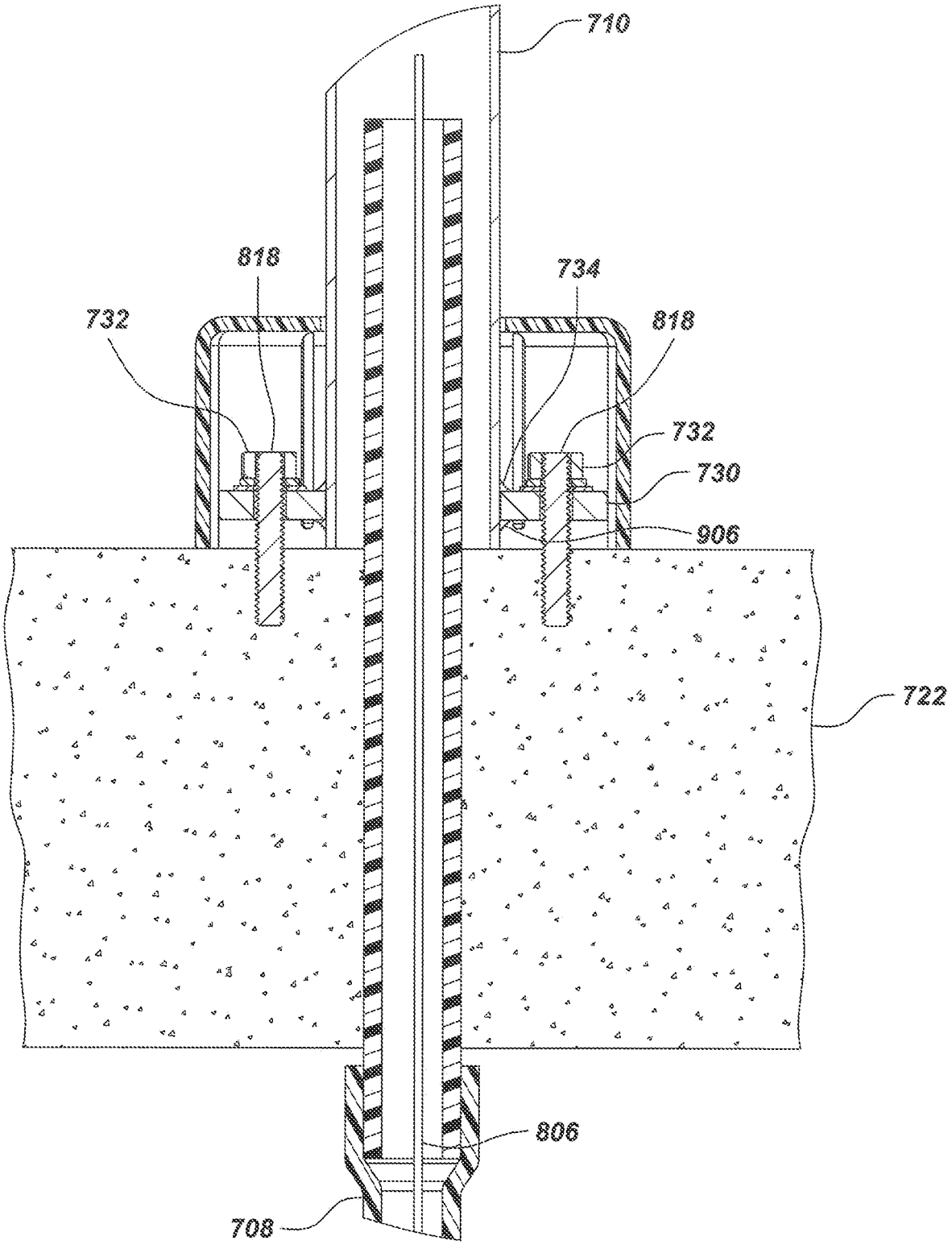
FIG. 9 is a detailed section of the path light in FIG. 8.

Turning to FIG. 9, an enlarged cut-away section view illustrates additional details of the path light embodiment 700. In an exemplary embodiment, the flange plate 730 may be attached to the end of a tubular support 710 by an upper weld 734 and a lower weld 906. Flange plate 730 may be formed with one or more holes such that flange plate 730 may be secured to concrete base 722 with bolts 818 and nuts 710. In an alternate embodiment, bolts 818 may be embedded in a separate concrete path which may be subsequently buried flush with, or slightly below ground level.

Figure 10:
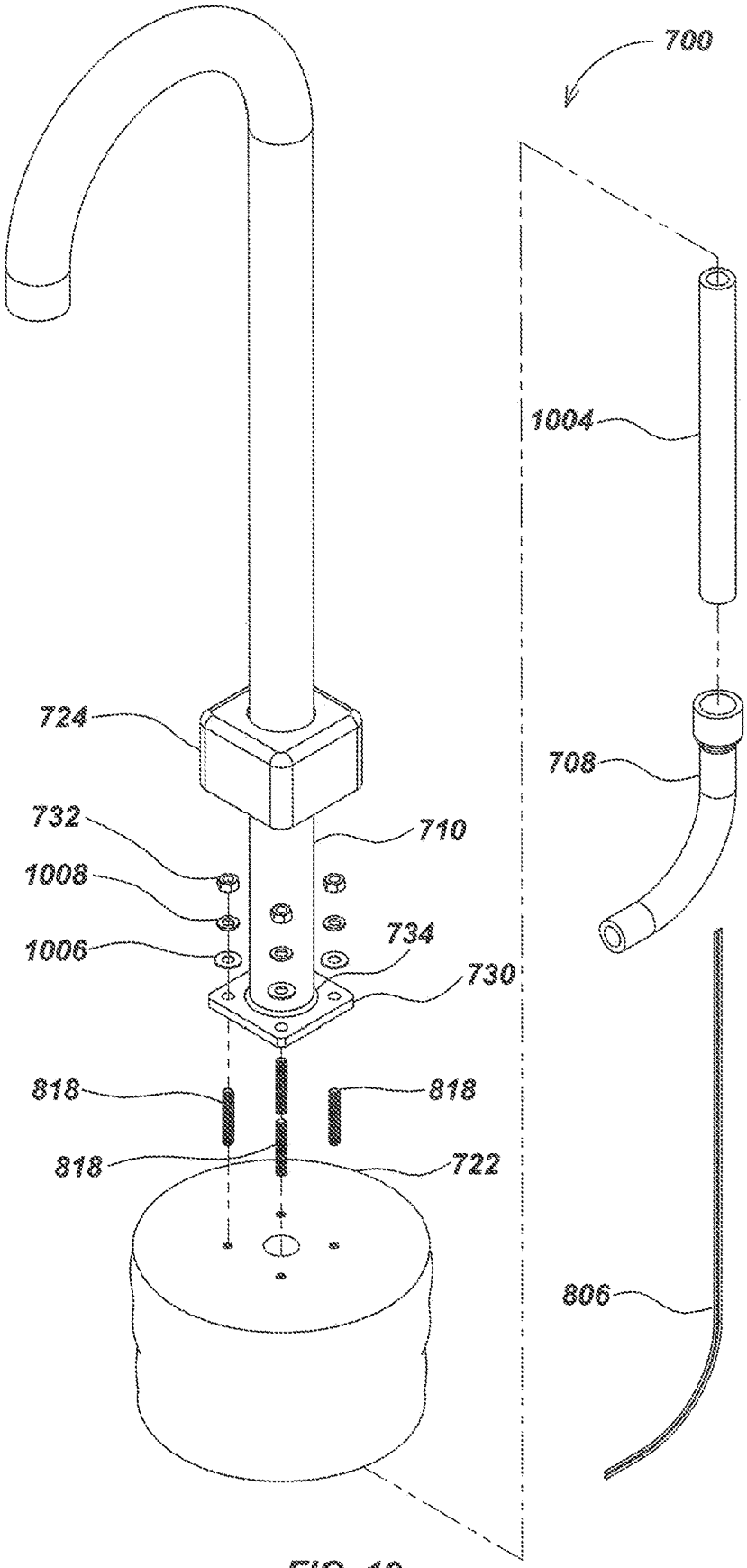
FIG. 10 is an exploded isometric view of a path light with anchors and hardware.

Turning to FIG. 10, an exploded view illustrates additional details of the J-shaped path light embodiment 700 as shown in FIGS. 7-9. In an exemplary embodiment, one or more holes may be formed into flange plate 730 for securing tubular support 710 to concrete base 722. For example, the holes formed in flange plate 730 may be lowered onto bolts 818, which may be set or disposed in a concrete base 722. Flange plate 730 may be secured by a flat washer 1006, a lock washer 1008, and a nut 732 threaded onto each bolt 818. Wires 806 may be routed through an upper conduit 1004, which may be disposed in a central passage formed in concrete block 722, and through a conduit elbow 708 to a power circuit (not shown).

Figure 11:
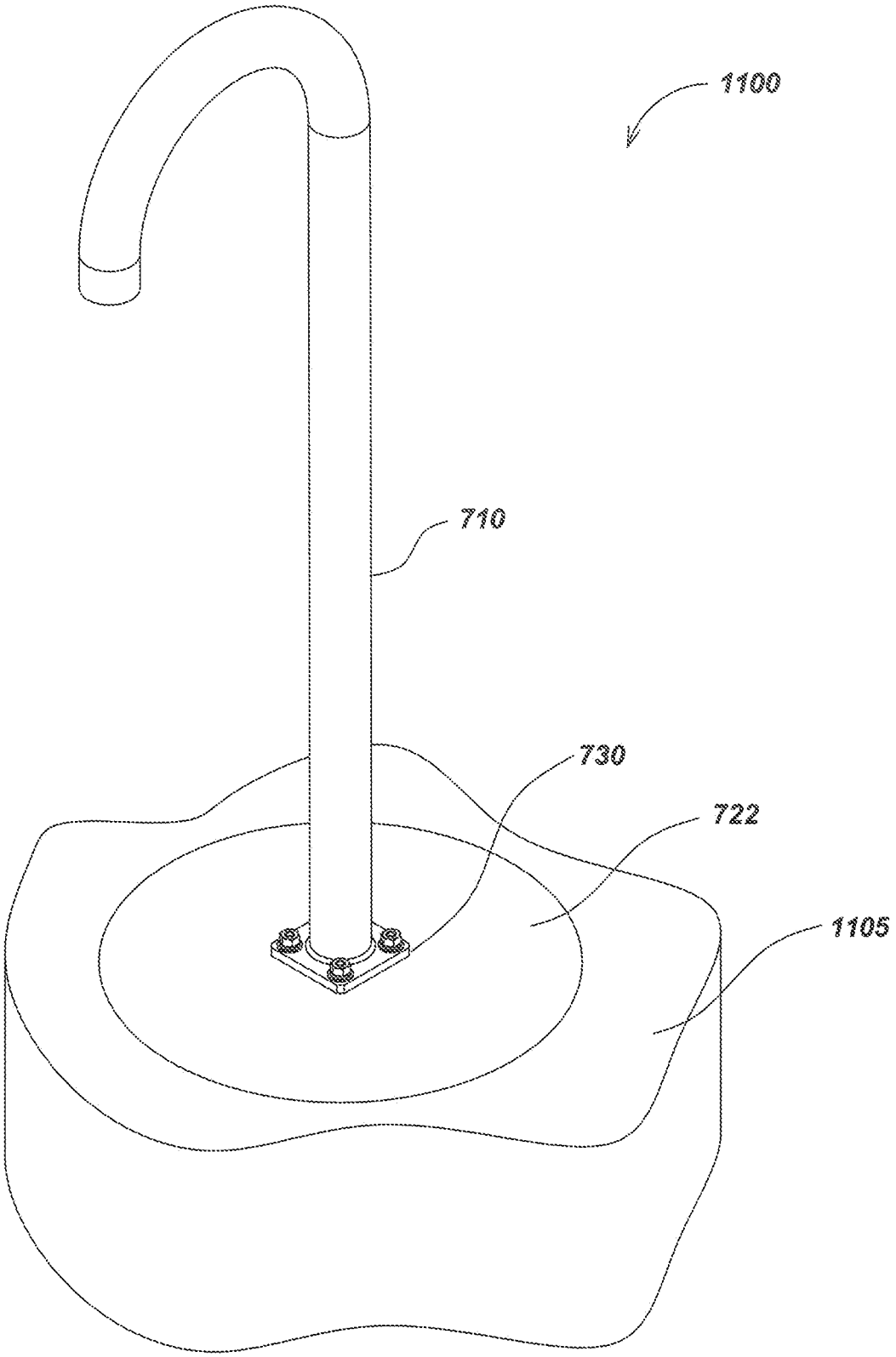
FIG. 11 is an isometric external view of a path light fastened to a buried concrete block.

Turning to FIG. 11, details of an installed J-shaped path light embodiment 1100 are illustrated. A tubular element, such as element 710 (as shown previously in FIGS. 7-10), may be connected to a flange plate 730. A concrete block 722 may be buried in earth 1105 such that the base of flange plate 730 may be approximately flush with the ground.

Figure 12:
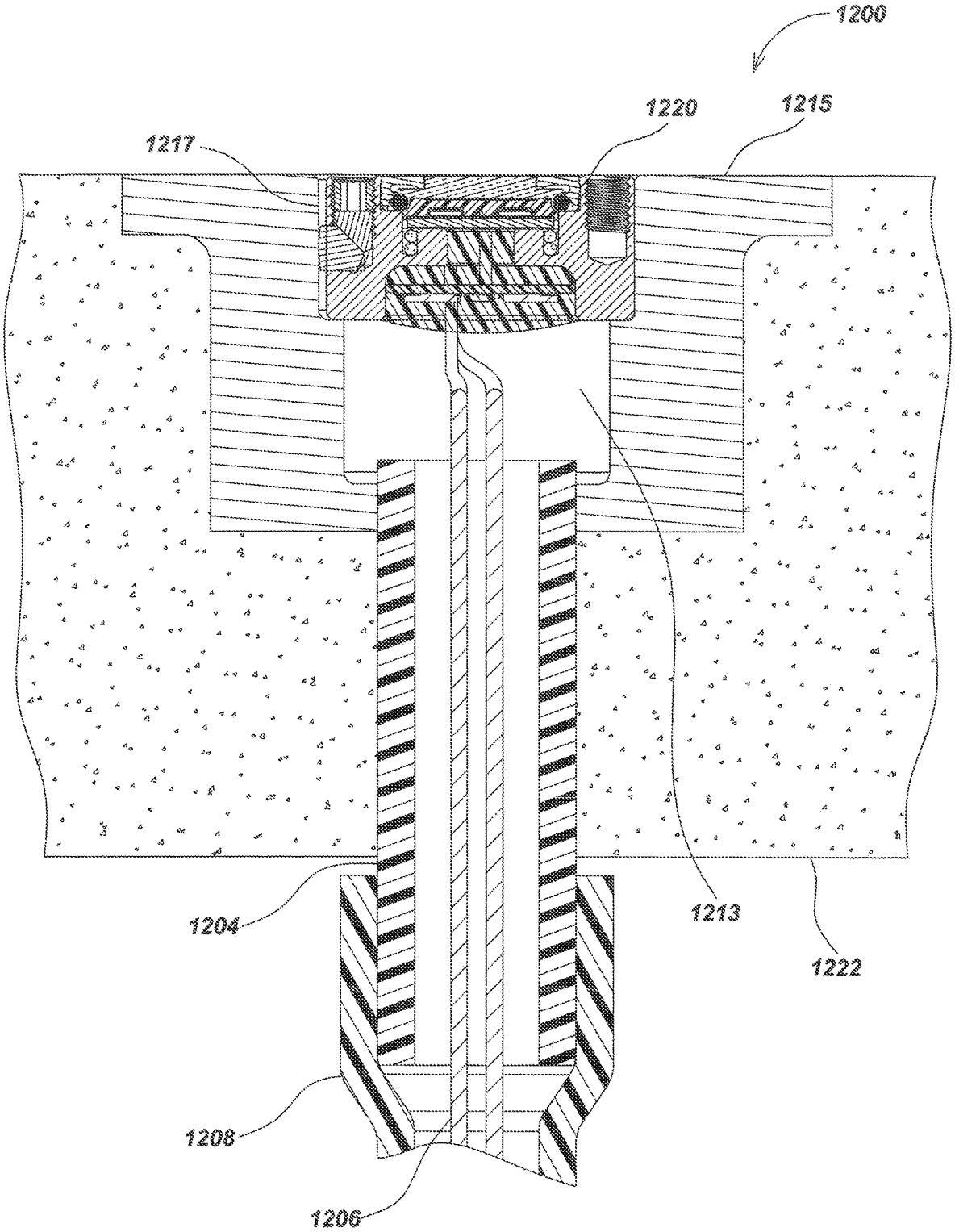
FIG. 12 is a cutaway section view of an alternate embodiment path light in a flush-mount configuration.

In some implementations, a path light may be mounted at the ground or surface level (flush mount) or below. Turning to FIG. 12, a cutaway section view illustrates details of one embodiment of a flush mounted path light fixture 1200. For example, a light fixture may be flush-mounted into a base matrix 1222, such as a concrete walkway or flooring. An LED light fixture sub-assembly 1220 may be supported in position within a metal support 1215 formed with a stepped recess 1217. The light fixture sub-assembly 1220 may be retained within the stepped recess 1217 by a retaining mechanism such as that shown in FIGS. 3A-3B and 5A-5B. Metal support 1215 may provide a thermal drain for dissipating heat from the LED light fixture sub-assembly 1220. Wires 1206, which may correspond to wires 106 of FIGS. 1 and 2 and 806 of FIG. 8-10 may be led to a power circuit through an upper conduit 1204, which may correspond to conduit 1004, and a conduit elbow 1208, which may correspond to 108 of FIGS. 1-2 and 708 of FIGS. 7-10, as described in previous embodiments. In an exemplary embodiment, a power circuit may be disposed within a cavity 1213 of flush-mounted path light fixture 1200.

Figure 13:
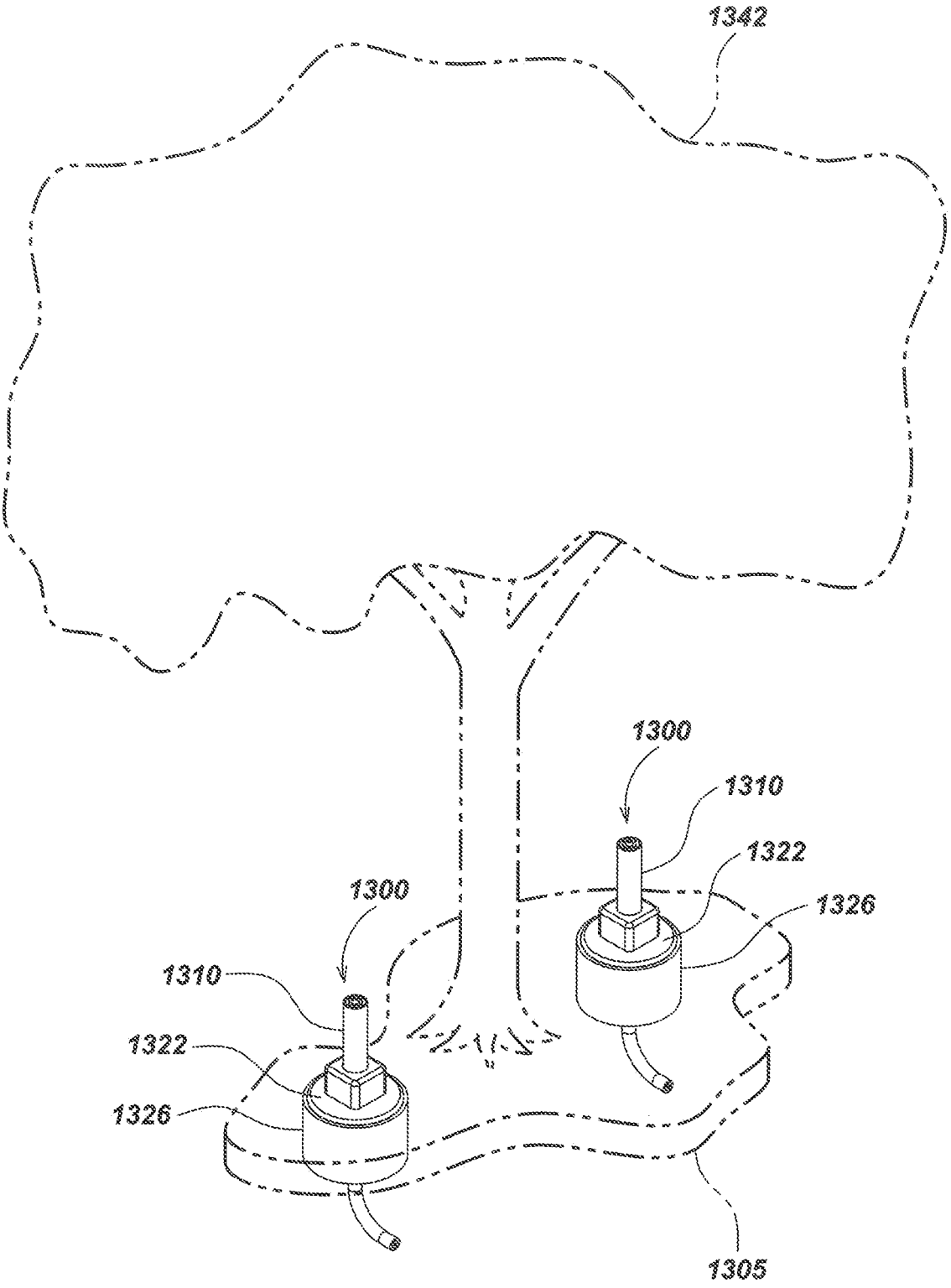
FIG. 13 is a perspective view of an alternate embodiment path light used in landscape lighting.

In another aspect, tubular support elements of the path light may be configured for use in various aspects of landscaping or other lighting requirements, either to provide light direction control, aesthetic appearance, or combinations of both. For example, turning to FIG. 13, an individual tree 1342 may be highlighted by one or more path lights 1300. Path lights 1300 may each include a vertical tubular support 1310 for directing light onto the tree 1342. In an exemplary embodiment, each of the path lights 1300 may be mounted to a roughly circular concrete block 1322 which may be poured in place using a cylindrical form 1326. The space around the concrete block 1322 may then be backfilled such that the top of the concrete block 1322 is flush with the ground 1305.

Figure 14:
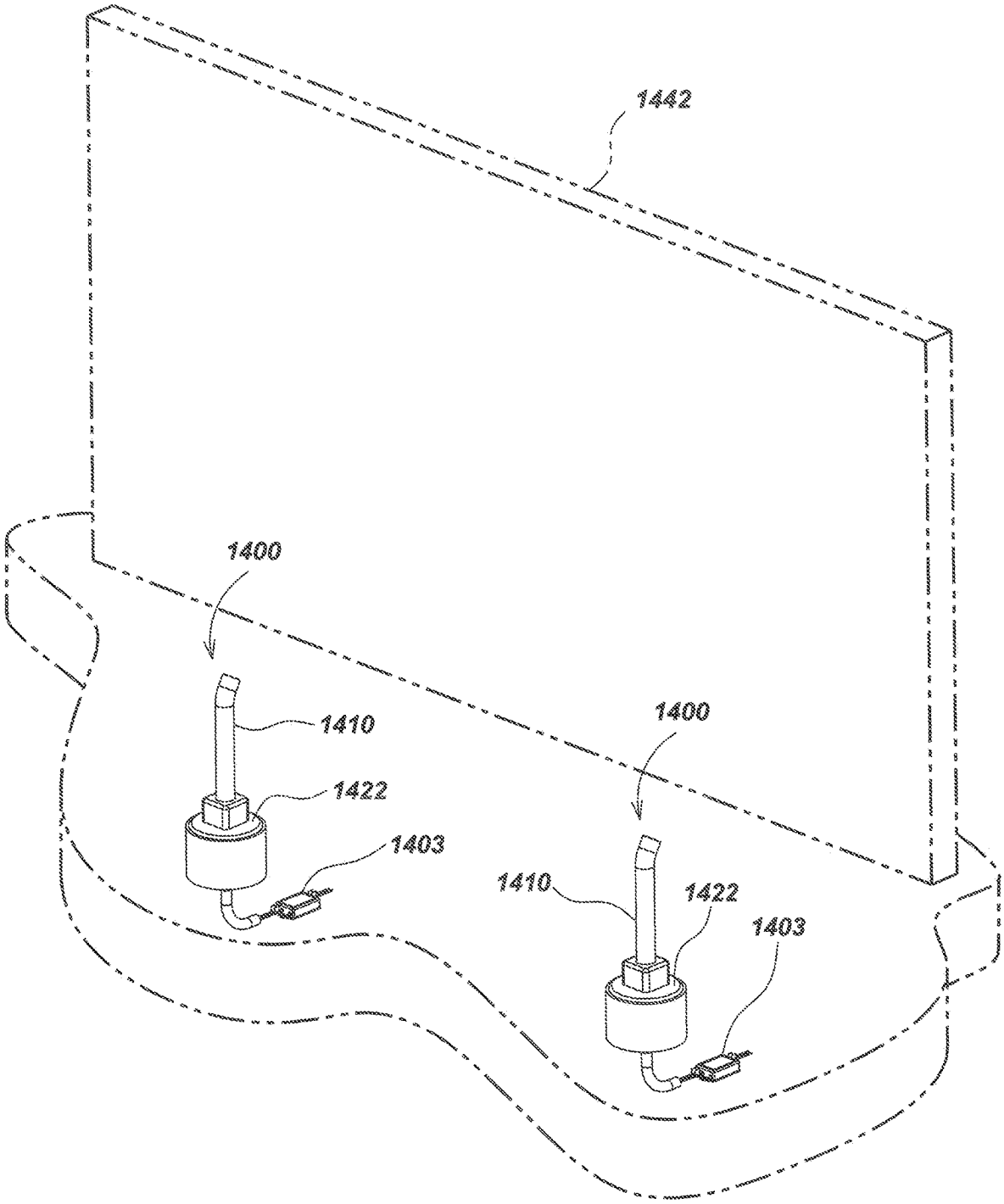
FIG. 14 is a perspective view of an alternate embodiment path light used in sign illumination.

Turning to FIG. 14, an area sign 1442 may be illuminated using one or more angled path lights 1400. Path lights 1400 may each include a tubular support 1410, and may each be electrically connected by wires (not shown) to a driver unit 1403, which provides conditioned DC current to power the path lights. Path lights 1400 may be mounted to cylindrical poured blocks 1422 in which mounting bolts may be mounted when poured, or otherwise affixed. In an alternate embodiment, driver units 1403 may each be placed inside path lights 1400.

Figure 15:
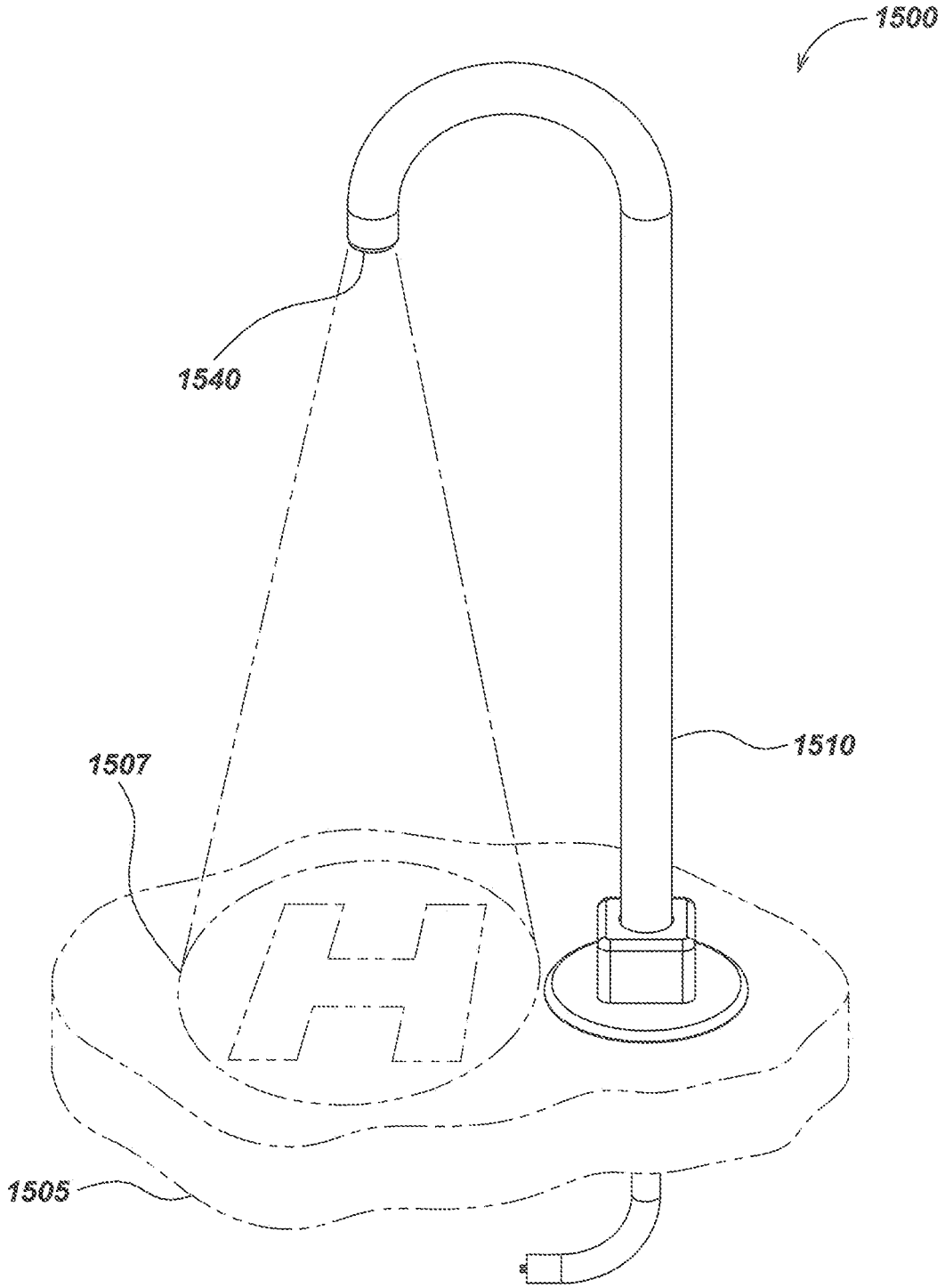
FIG. 15 is an isometric view of a path light embodiment configured with a projection sub-assembly.

In some embodiments, light output may be further controlled to provide images, graphics, controlled directional placement, or other display features. For example, a projection element may be placed at the outlet of the light and/or in proximity to one or more LED elements to generate a particular image, graphic, or other feature. Turning to FIG. 15, various aspects of a path light embodiment 1500 including a projection element are illustrated. In an exemplary embodiment, a physical template, such as a GOBO device (not shown) may be positioned in front of a light outlet element 1540, which may be disposed at the open end of a tubular support 1510, for modifying the shape of the emitted light to provide a projected image 1507 onto a surface 1505. The GOBO or other projection element may be secured to the open end of a tubular support 1510 with, for example, a retaining plate and one or more screws (not shown).

Figure 16:
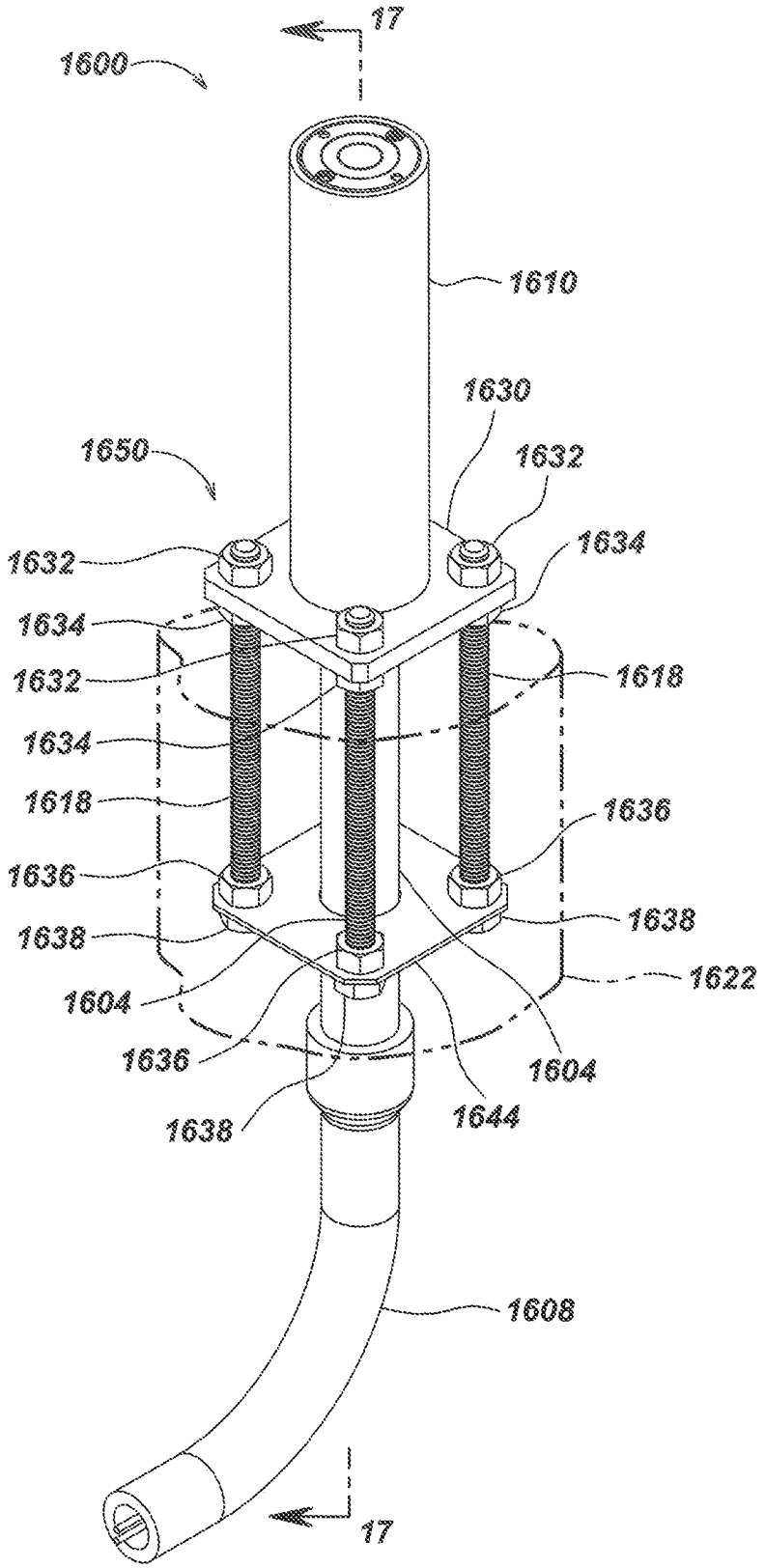
FIG. 16 is a cutaway view of an anchoring mechanism for a path light.

Turning to FIG. 16, a foundation block, which may be made of concrete or similar material, may be poured around a frame configured to support one or more retaining rods. For example, a short straight-tube path light embodiment 1600 may include a vertical tubular support 1610 welded to an upper flange plate 1630. The upper flange plate 1630 may be secured to the upper end of one or more retaining rods, such as threaded rods 1618, which may be inserted through holes in the corners of the upper flange plate 1630, and secured on each rod by an upper top nut 1632 and an upper bottom nut 1634. The lower end of each of the threaded rods 1618 may be secured to a lower flange plate 1644 by means of a lower top nut 1636 and a lower bottom nut 1638. The mounting frame 1650 formed by the threaded rods, nuts, and flange plates provides a rigid support for the path light 1600, the wire conduit 1604 and the lower conduit elbow 1608 to be held in a stable orientation during the pouring of a concrete block 1622. The mounting frame 1650 may further provide a robust attachment for the path light 1600 to the concrete block 1622.

The mounting system shown in FIG. 16 may be used in a poured walkway installation where path lights may be required to illuminate a sidewalk, for example, as well as in the poured-block installation illustrated.

Figure 17:
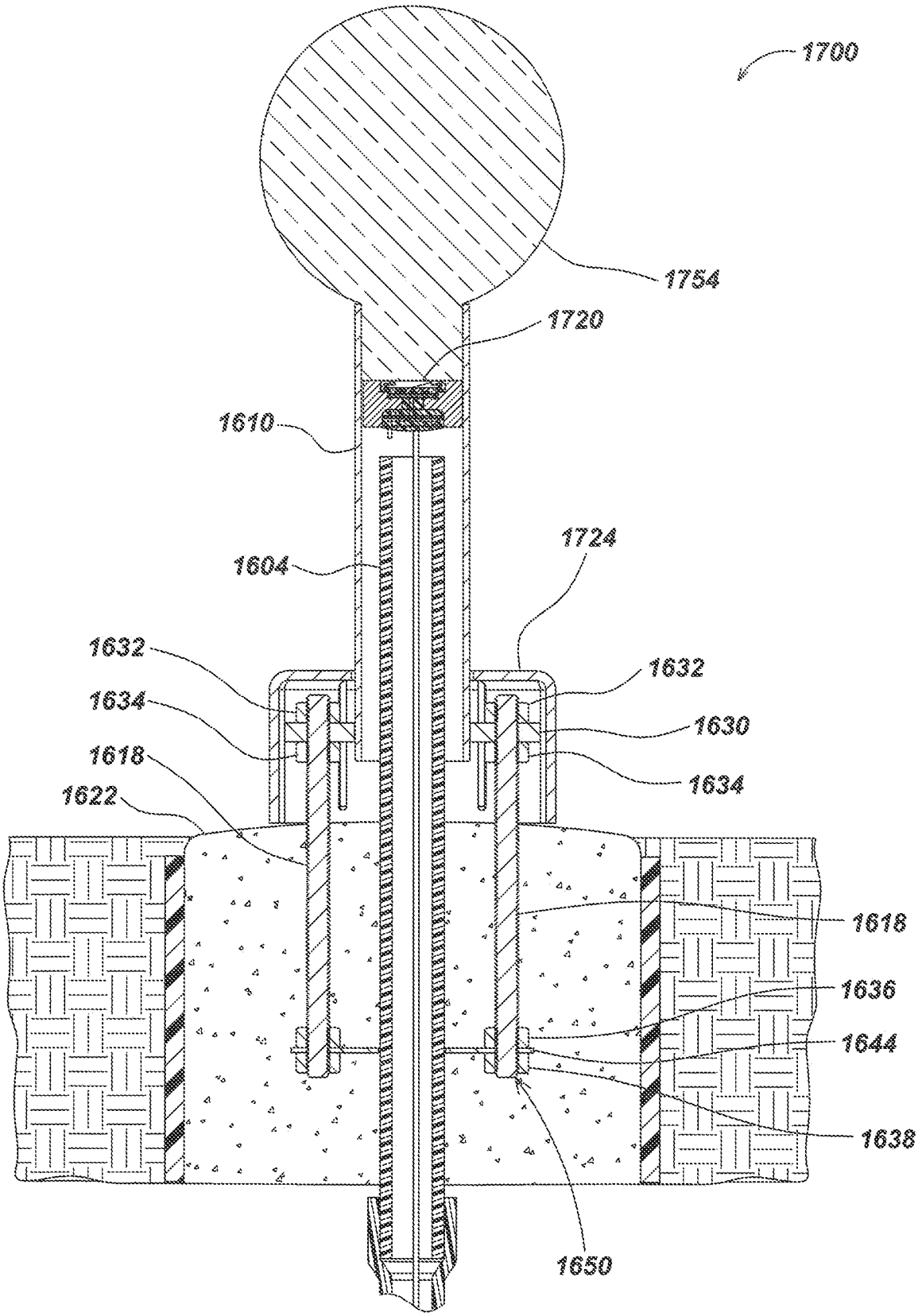
FIG. 17 is a section view of a path light using the anchoring mechanism shown in FIG. 16 with a decorative accessory.

Turning to FIG. 17, a vertical section view illustrates details of a path light embodiment 1700 configured with a beam forming device 1754. In an exemplary embodiment, mounting frame 1650, which may include threaded rods 1618, upper flange plate 1630, lower flange plate 1644, upper top nuts 1632, upper bottom nuts 1634, lower top nuts 1636, and lower bottom nuts 1638 may be used for supporting a straight-tube path light 1700 installed in a poured block 1622. A protective cover 1624 may be used to cover the upper flange plate 1630 and the protruding ends of the threaded rods 1618.

Referring still to FIG. 17, the emitted beam from a light engine may be output and controlled through various elements (not shown) such as reflectors, various diffusing or focusing attachments, color filters, prisms, polarizing attachments, holographic attachments, and/or by recessing the light engine within a tubular support. Path light embodiment 1700 may include a light engine 1720 recessed within the vertical tubular support 1610 such that the inner walls of the vertical tubular support 1610 may form the emitted light beam into a columnar form. Beam forming device 1754 may be affixed to the top end of the vertical tubular support 1610 which may serve as a decorative globe, a diffuser, or a decorative accessory of some kind, such as a seasonal decoration or a corporate symbol.

Figure 18:
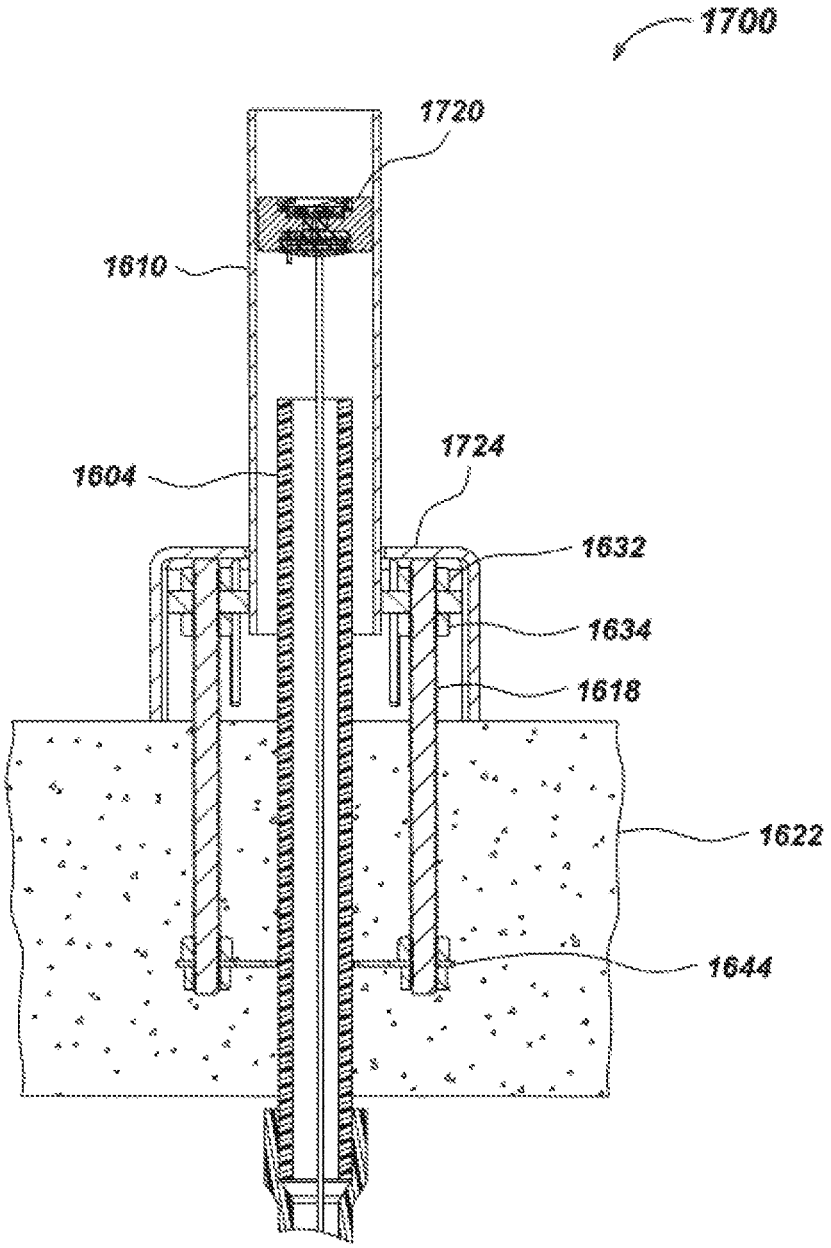
FIG. 18 is a section view of a path light using the anchoring mechanism shown in FIG. 16 with the light engine recessed to form the emitted beam.

Turning to FIG. 18, a cutaway section view illustrates additional details of embodiment 1700 as shown in FIG. 17. In an exemplary embodiment, light engine 1720 may be recessed into vertical tubular support 1610 producing edge cut-off in the emitted beam. Alternatively, a variety of reflectors may be used to form the light beam. For example, the mounting system as shown in FIG. 17 may be used to mount a path light embodiment 1700 in a poured concrete block 1622.

Figure 19:
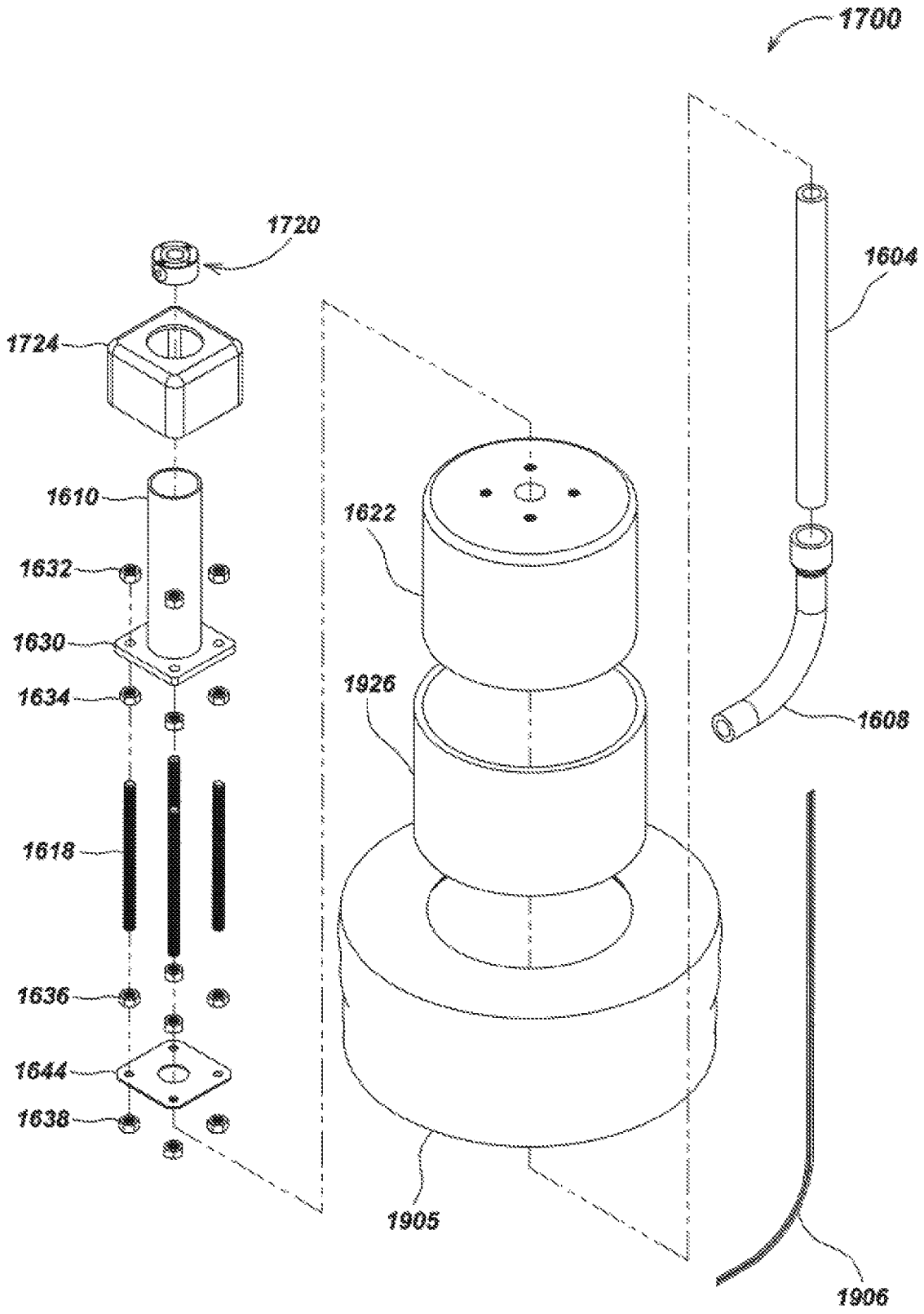
FIG. 19 is an exploded view of the anchoring system in FIG. 16.
Figure 20D:
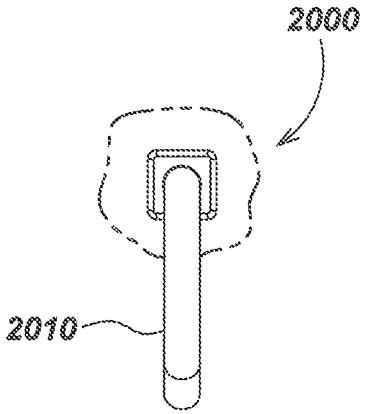
FIG. 20D is a top view of the path light embodiment of FIG. 20A.
Figure 20A:
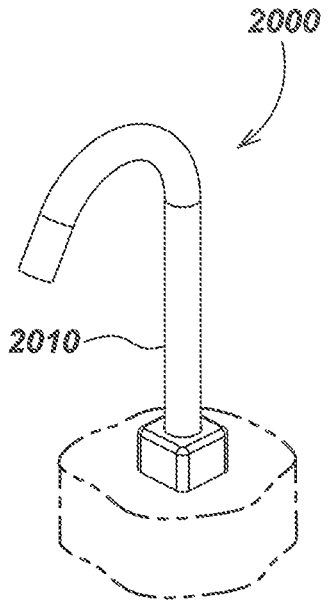
FIG. 20A is an isometric view of a path light embodiment configured with a short curved tubular support.
Figure 20B:
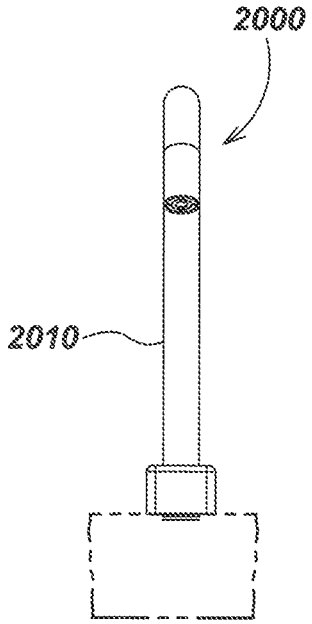
FIG. 20B is a front view of the path light embodiment of FIG. 20A.
Figure 20C:
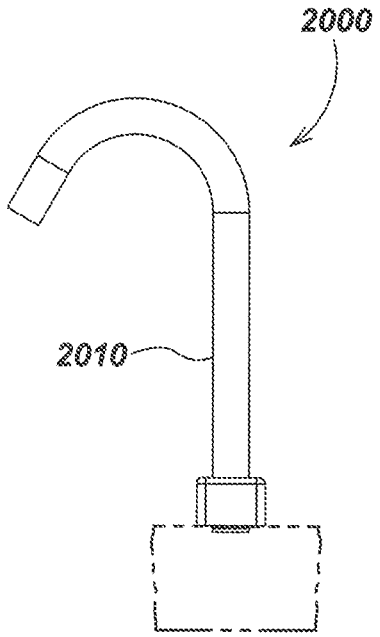
FIG. 20C is a side view of the path light embodiment of FIG. 20A.
Figure 21D:
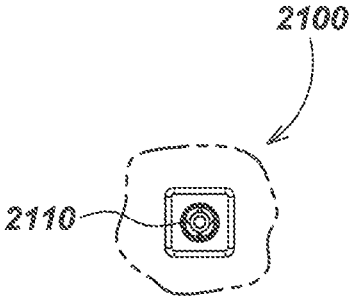
FIG. 21D is a top view of the path light embodiment of FIG. 21A.
Figure 21A:
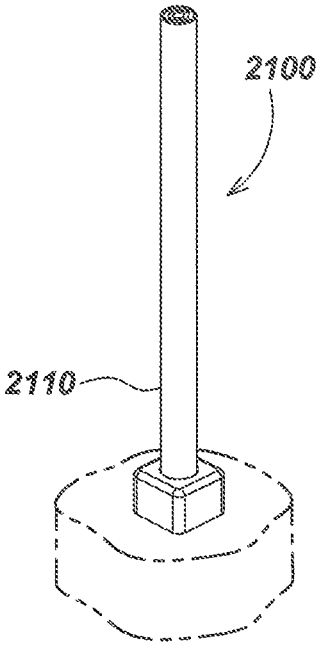
FIG. 21A is an isometric view of a path light embodiment configured with a tall straight tubular support.
Figure 21B:
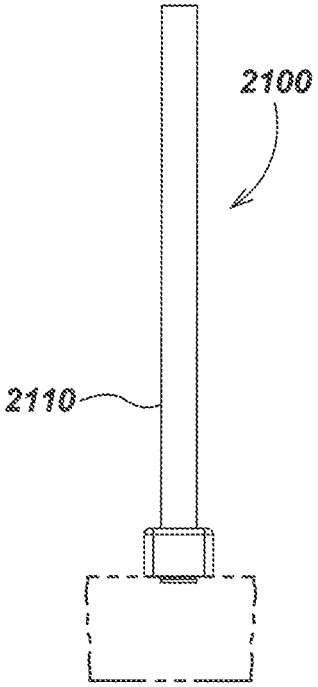
FIG. 21B is a front view of the path light embodiment of FIG. 21A.
Figure 21C:
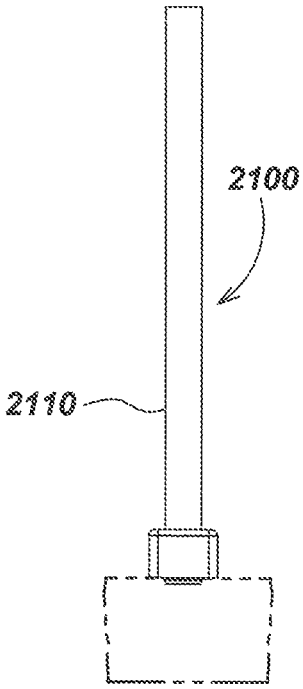
FIG. 21C is a side view of the path light embodiment of FIG. 21A.
Figure 22D:
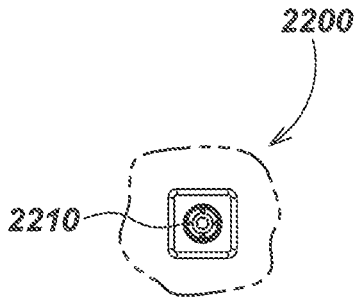
FIG. 22D is a top view of the path light embodiment of FIG. 22A.
Figure 22A:
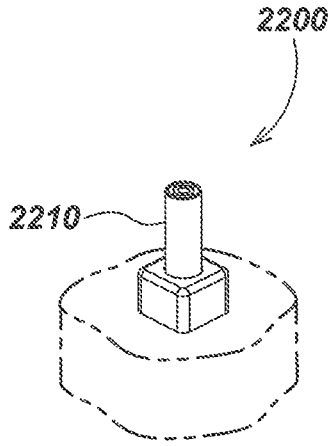
FIG. 22A is an isometric view of a path light embodiment configured with a short straight tubular support.
Figure 22B:
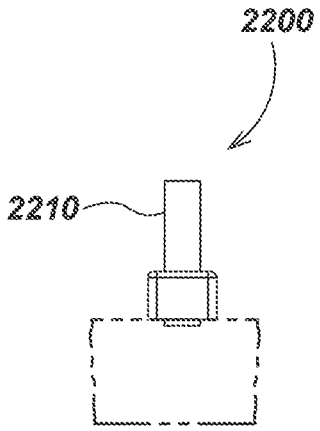
FIG. 22B is a front view of the path light embodiment of FIG. 22A.
Figure 22C:
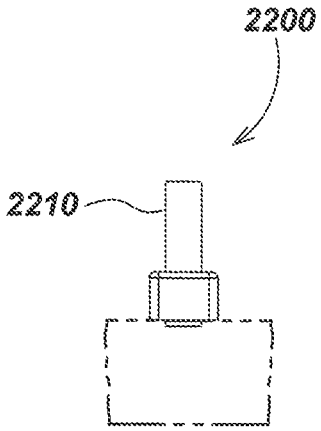
FIG. 22C is a side view of the path light embodiment of FIG. 22A.
Figure 23D:
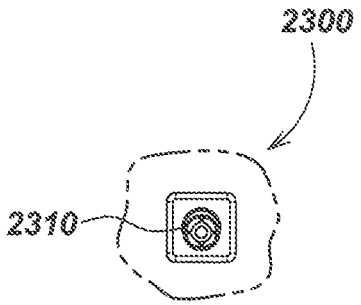
FIG. 23D is a top view of the path light embodiment of FIG. 23A.
Figure 23A:
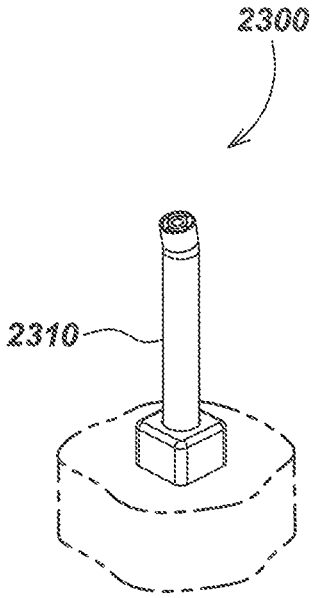
FIG. 23A is an isometric view of a path light embodiment configured with a shallow-angled tubular support.
Figure 23B:
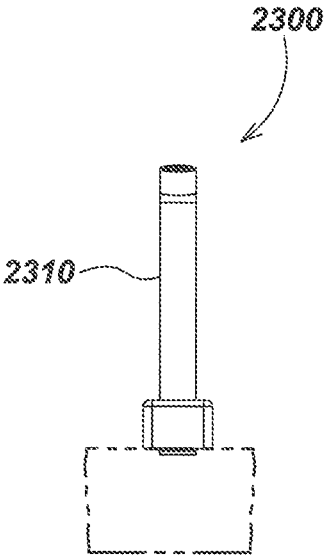
FIG. 23B is a front view of the path light embodiment of FIG. 23A.
Figure 23C:
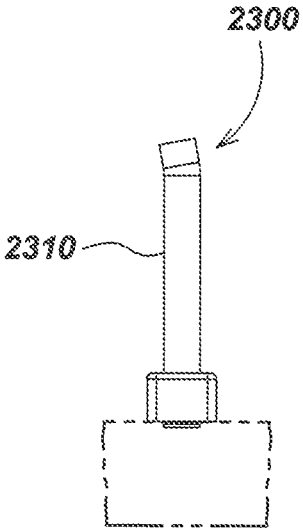
FIG. 23C is a side view of the path light embodiment of FIG. 23A.
Figure 24D:
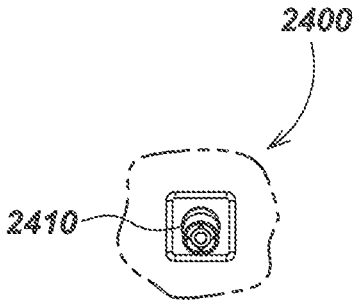
FIG. 24D is a top view of the path light embodiment of FIG. 24A.
Figure 24A:
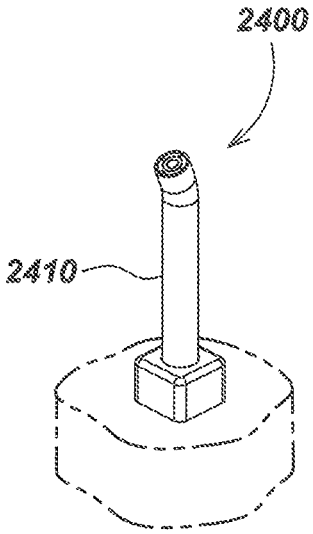
FIG. 24A is an isometric view of a path light embodiment configured with a slightly-angled tubular support.
Figure 24B:
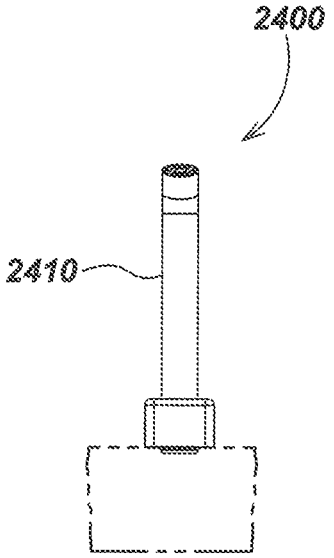
FIG. 24B is a front view of the path light embodiment of FIG. 24A.
Figure 24C:
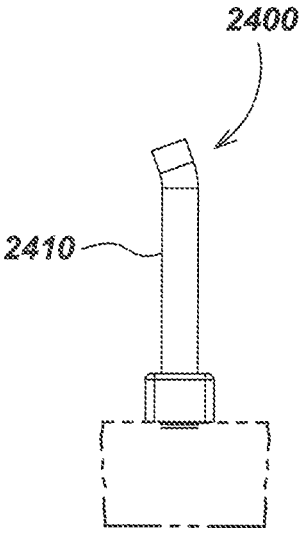
FIG. 24C is a side view of the path light embodiment of FIG. 24A.
Figure 25D:
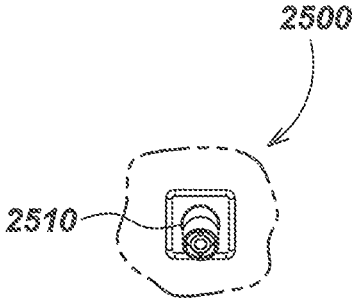
FIG. 25D is a top view of the path light embodiment of FIG. 25A.
Figure 25A:
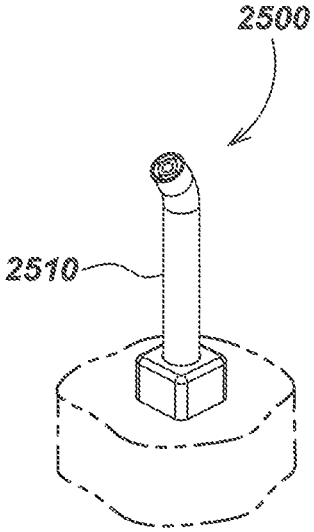
FIG. 25A is an isometric view of a path light embodiment configured with a moderately-angled tubular support.
Figure 25B:
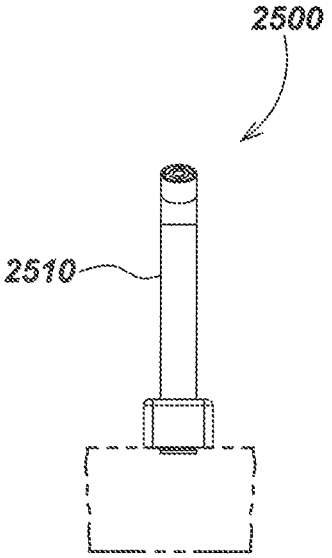
FIG. 25B is a front view of the path light embodiment of FIG. 25A.
Figure 25C:
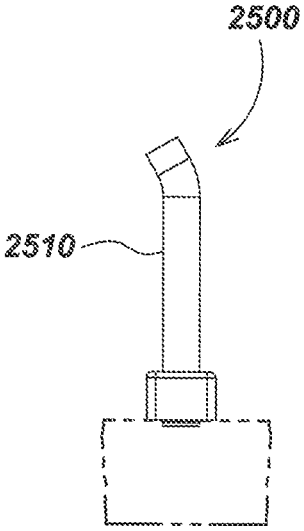
FIG. 25C is a side view of the path light embodiment of FIG. 25A.
Figure 26D:
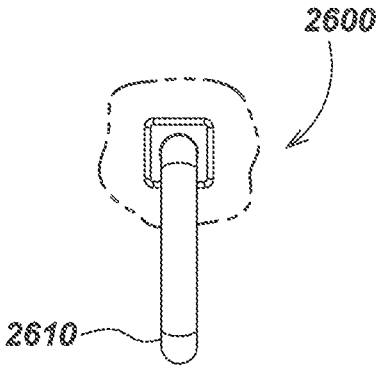
FIG. 26D is a top view of the path light embodiment of FIG. 26A.
Figure 26A:
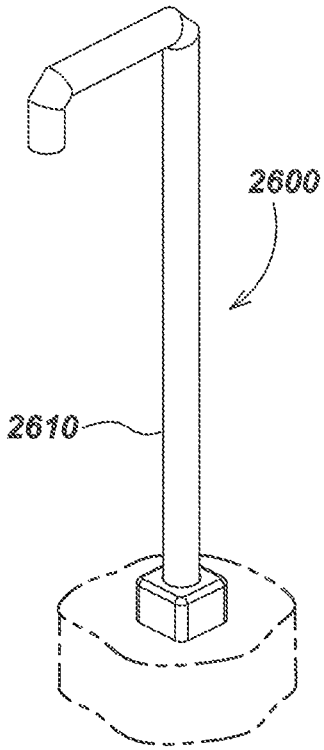
FIG. 26A is an isometric view of a path light embodiment configured with a squared cane tubular support.
Figure 26B:
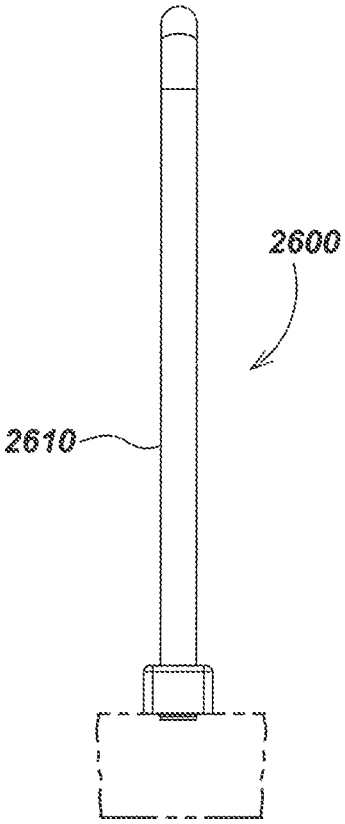
FIG. 26B is a front view of the path light embodiment of FIG. 26A.
Figure 26C:
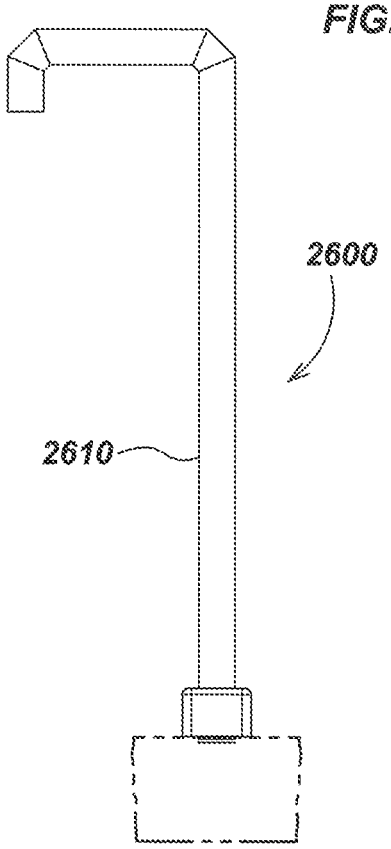
FIG. 26C is a side view of the path light embodiment of FIG. 26A.
Figure 27D:
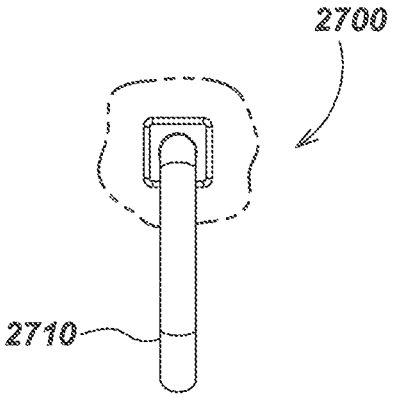
FIG. 27D is a top view of the path light embodiment of FIG. 27A.
Figure 27A:
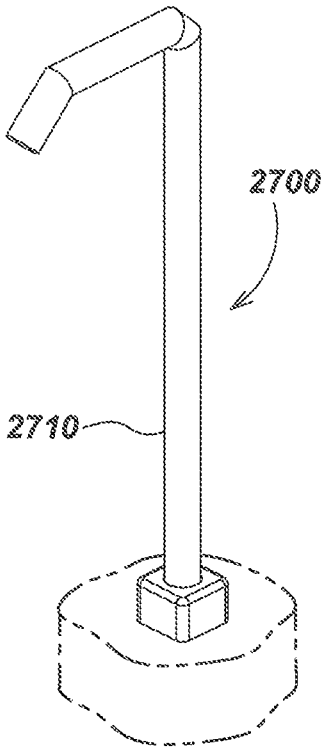
FIG. 27A is an isometric view of a path light embodiment configured with a squared cane tubular support with an angled light outlet.
Figure 27B:
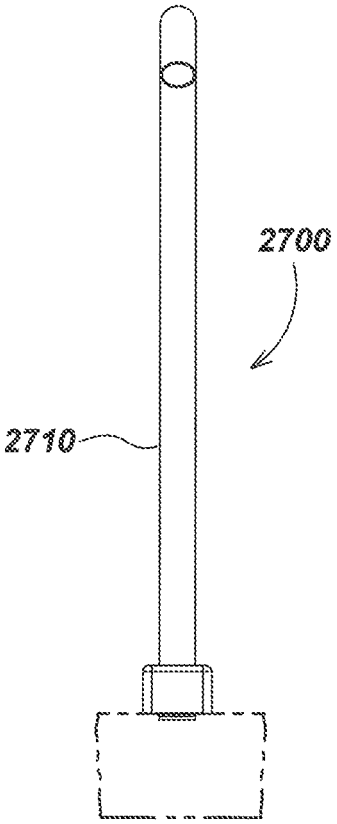
FIG. 27B is a front view of the path light embodiment of FIG. 27A.
Figure 27C:
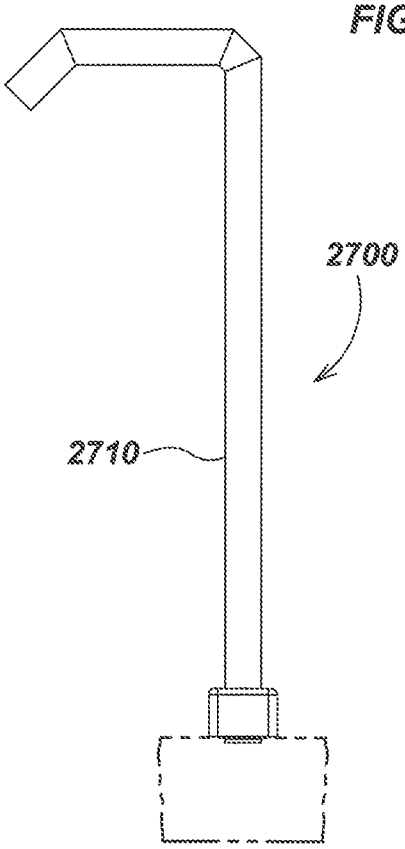
FIG. 27C is a side view of the path light embodiment of FIG. 27A.
Figure 28D:
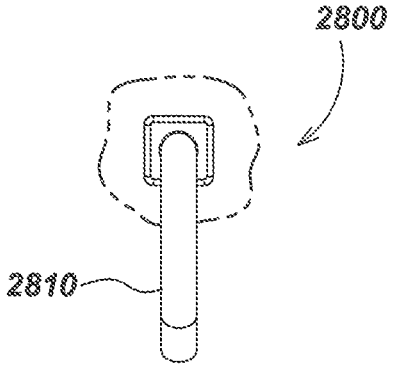
FIG. 28D is a top view of the path light embodiment of FIG. 28A.
Figure 28A:
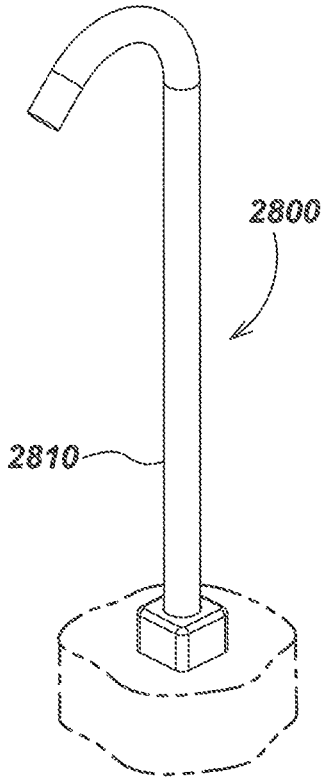
FIG. 28A is an isometric view of a path light embodiment configured with a curved tubular support with an angled light outlet.
Figure 28B:
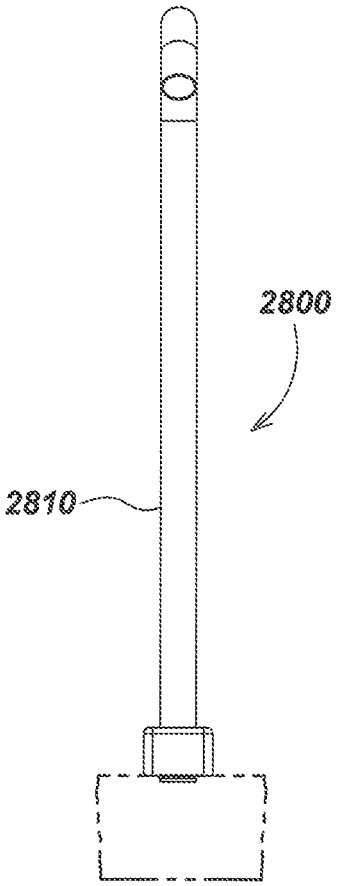
FIG. 28B is a front view of the path light embodiment of FIG. 28A.
Figure 28C:
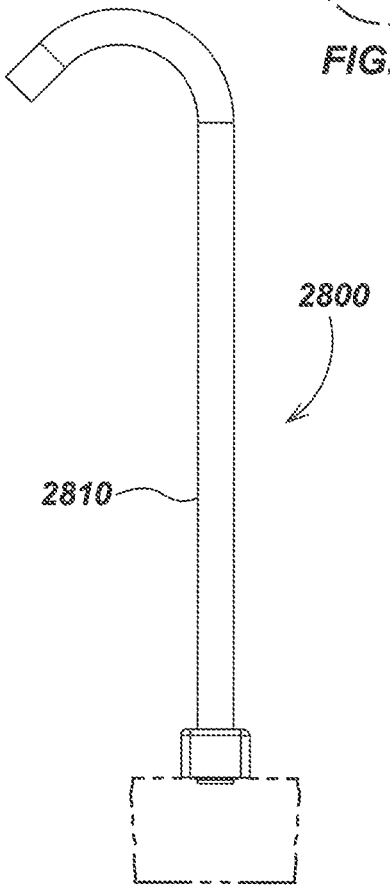
FIG. 28C is a side view of the path light embodiment of FIG. 28A.
Figure 29D:
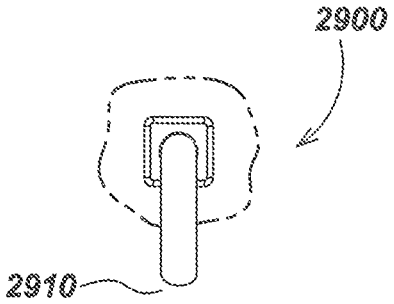
FIG. 29D is a top view of the path light embodiment of FIG. 29A.
Figure 29A:
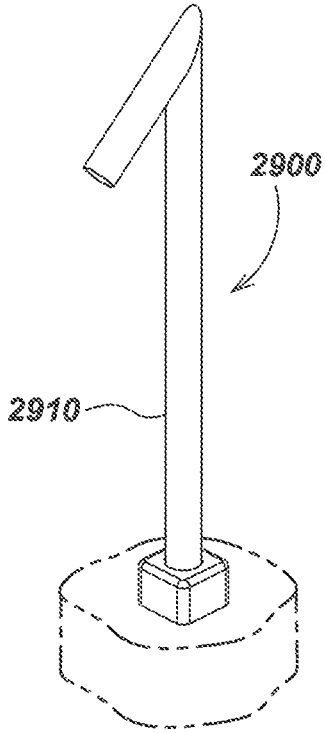
FIG. 29A is an isometric view of a path light embodiment configured with a triangular tubular support.
Figure 29B:
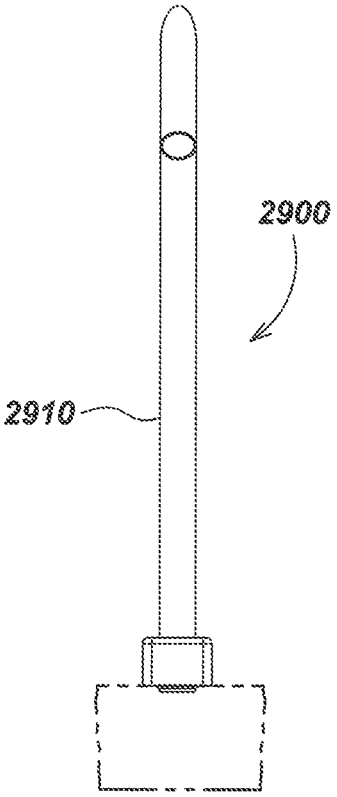
FIG. 29B is a front view of the path light embodiment of FIG. 29A.
Figure 29C:
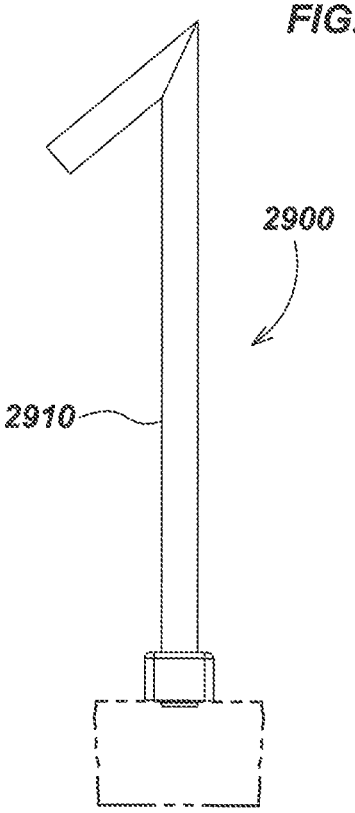
FIG. 29C is a side view of the path light embodiment of FIG. 29A.
Figure 30D:
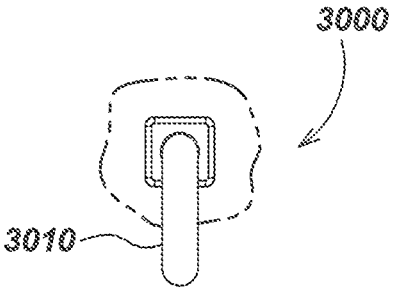
FIG. 30D is a top view of the path light embodiment of FIG. 30A.
Figure 30A:
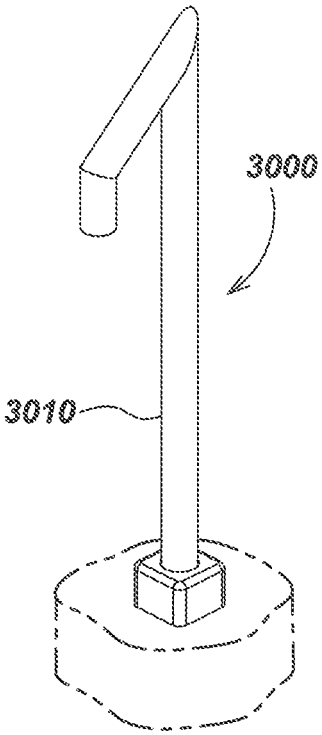
FIG. 30A is an isometric view of a path light embodiment configured with a triangular tubular support with downward angled light outlet.
Figure 30B:
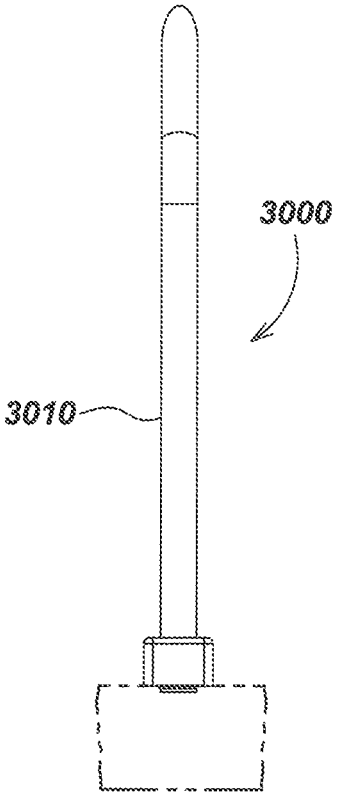
FIG. 30B is a front view of the path light embodiment of FIG. 30A.
Figure 30C:
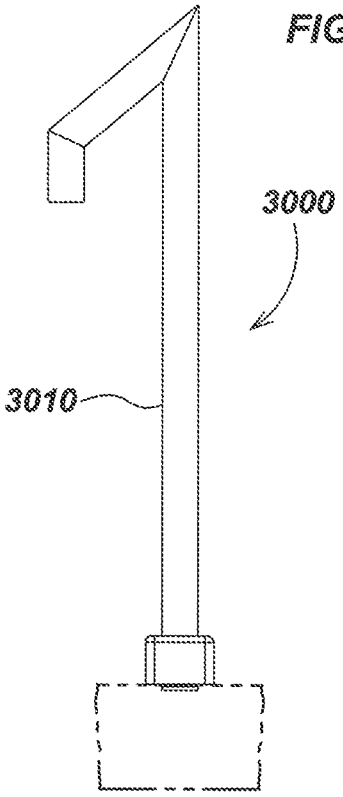
FIG. 30C is a side view of the path light embodiment of FIG. 30A.
Figure 31D:
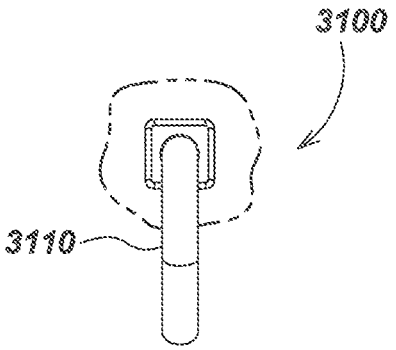
FIG. 31D is a top view of the path light embodiment of FIG. 31A.
Figure 31A:
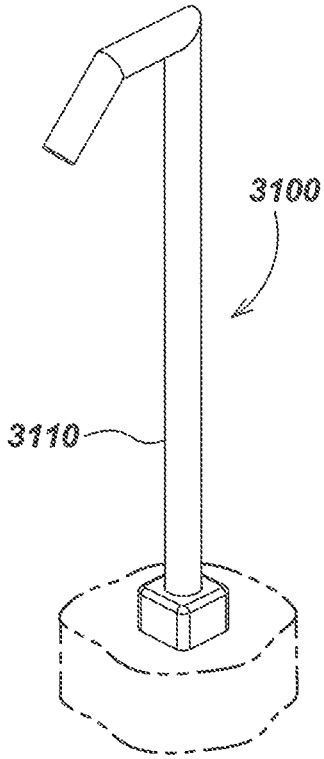
FIG. 31A is an isometric view of a path light embodiment configured with a triangular tubular support with angled light outlet.
Figure 31B:
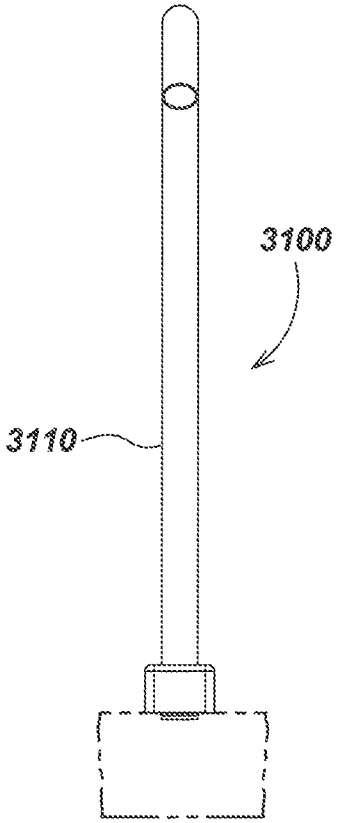
FIG. 31B is a front view of the path light embodiment of FIG. 31A.
Figure 31C:
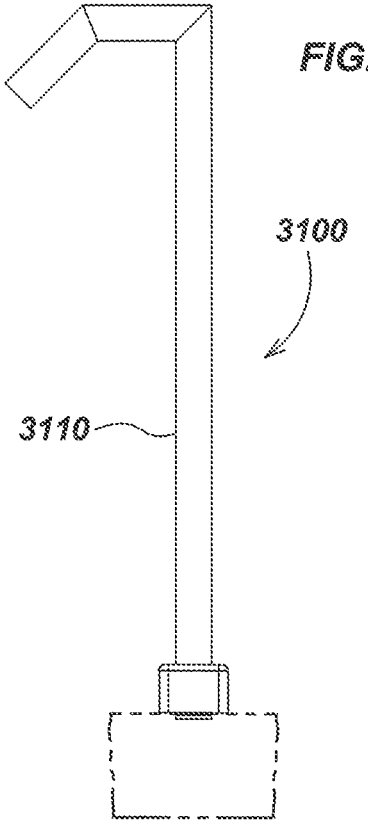
FIG. 31C is a side view of the path light embodiment of FIG. 31A.
Figure 32D:
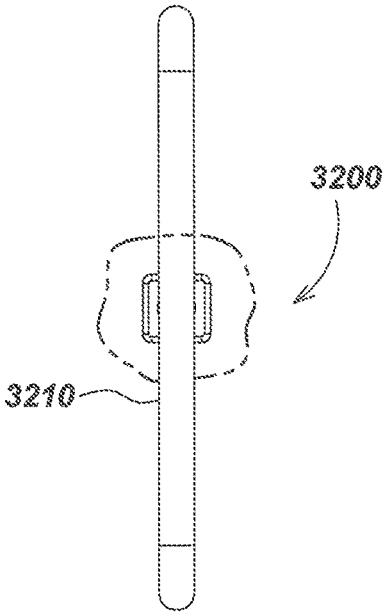
FIG. 32D is a top view of the path light embodiment of FIG. 32A.
Figure 32A:
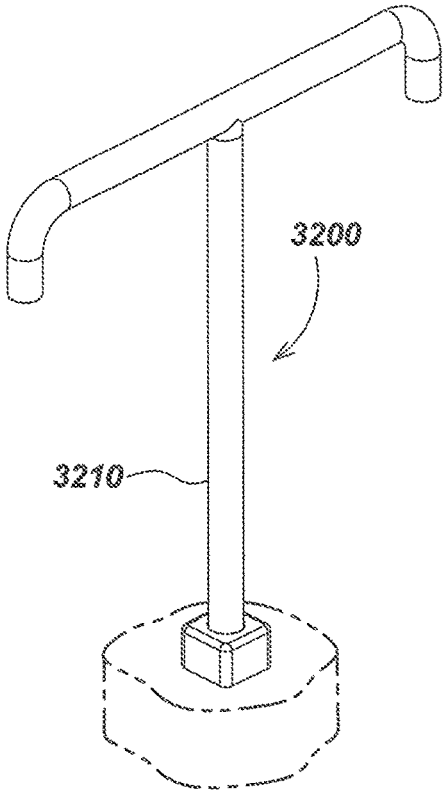
FIG. 32A is an isometric view of a path light embodiment configured with a T-shaped tubular support.
Figure 32B:
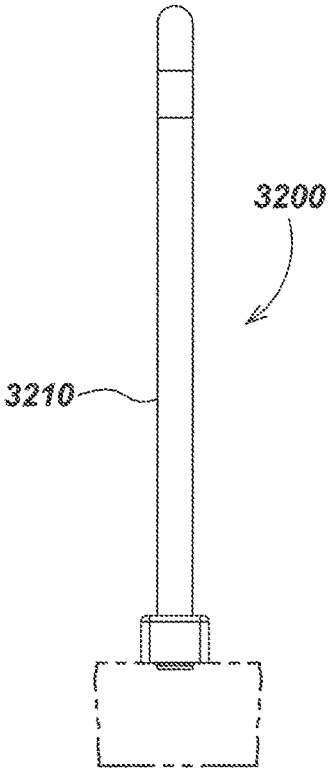
FIG. 32B is a front view of the path light embodiment of FIG. 32A.
Figure 32C:
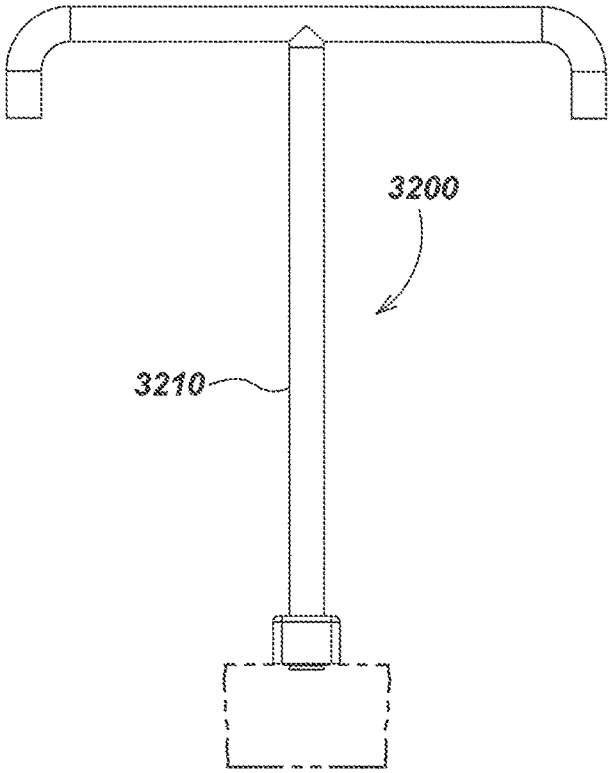
FIG. 32C is a side view of the path light embodiment of FIG. 32A.
Figure 33D:
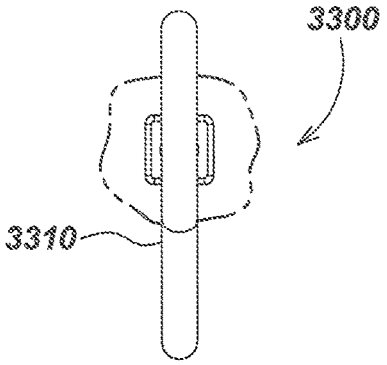
FIG. 33D is a top view of the path light embodiment of FIG. 33A.
Figure 33A:
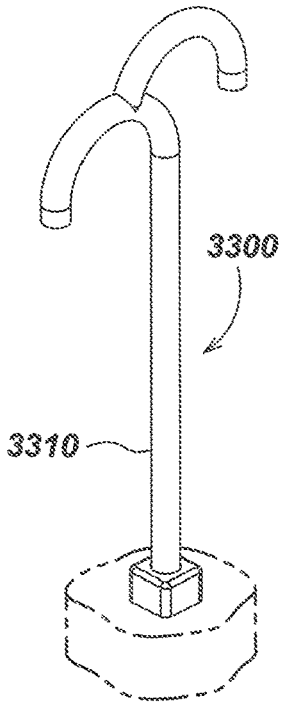
FIG. 33A is an isometric view of a path light embodiment configured with an arched segment coupled to a single cane shaped tubular support.
Figure 33B:
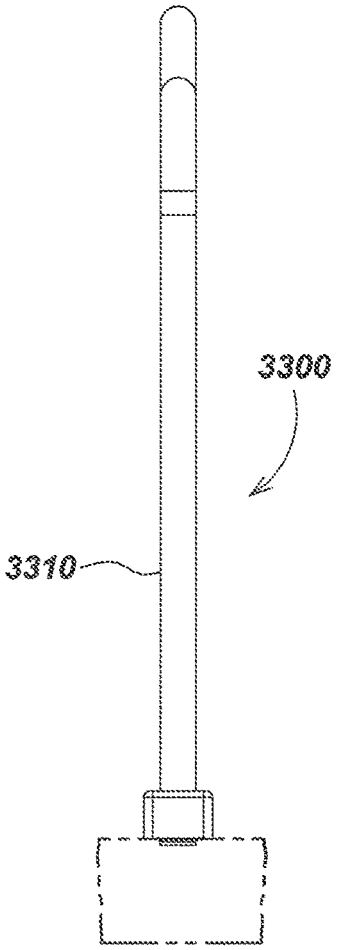
FIG. 33B is a front view of the path light embodiment of FIG. 33A.
Figure 33C:
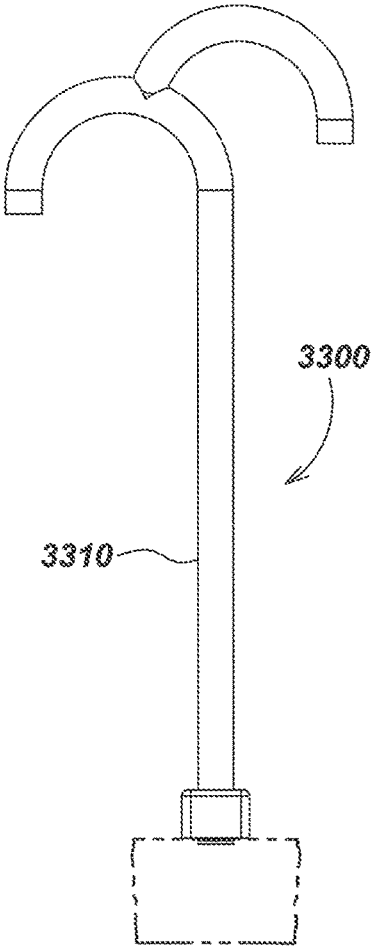
FIG. 33C is a side view of the path light embodiment of FIG. 33A.
Figure 34D:
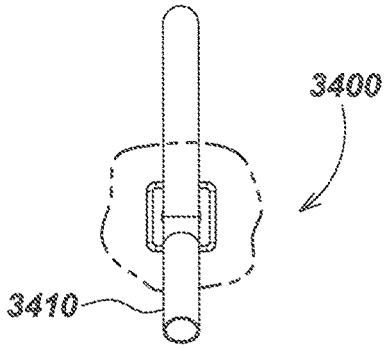
FIG. 34D is a top view of the path light embodiment of FIG. 34A.
Figure 34A:
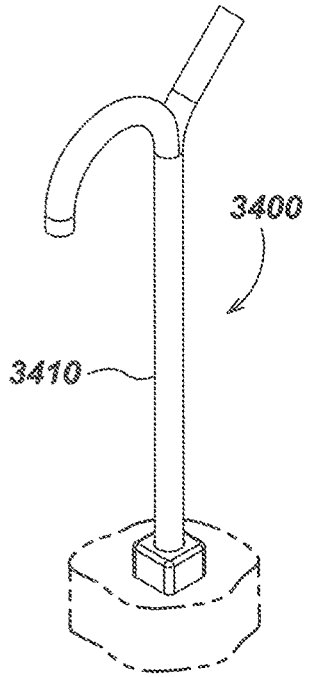
FIG. 34A is an isometric view of a path light embodiment configured with an angled segment coupled to a single cane shaped tubular support.
Figure 34B:
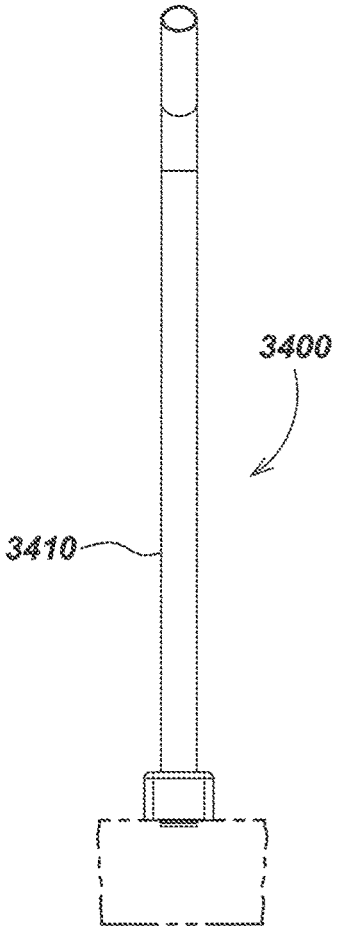
FIG. 34B is a front view of the path light embodiment of FIG. 34A.
Figure 34C:
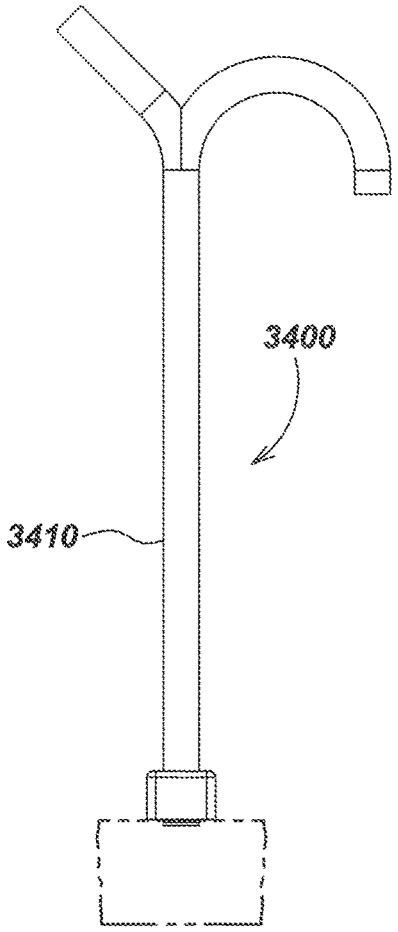
FIG. 34C is a side view of the path light embodiment of FIG. 34A.
Figure 35D:
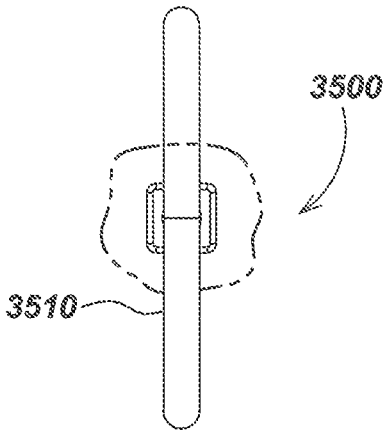
FIG. 35D is a top view of the path light embodiment of FIG. 35A.
Figure 35A:
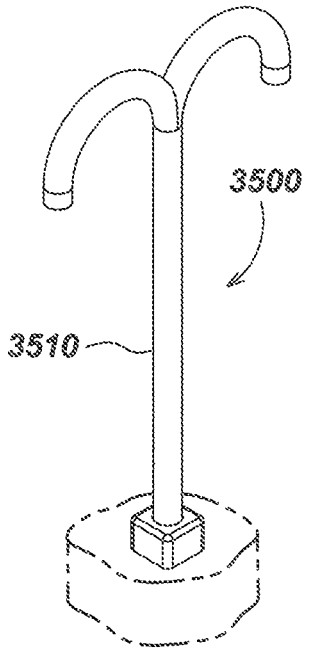
FIG. 35A is an isometric view of a path light embodiment configured with a tubular support with two symmetrical arched segments.
Figure 35B:
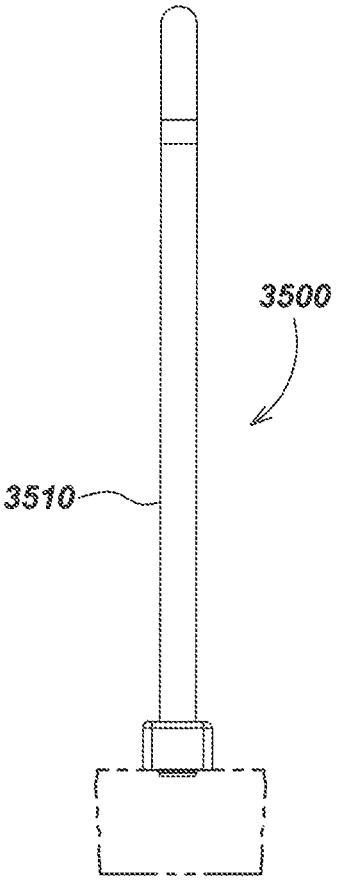
FIG. 35B is a front view of the path light embodiment of FIG. 35A.
Figure 35C:
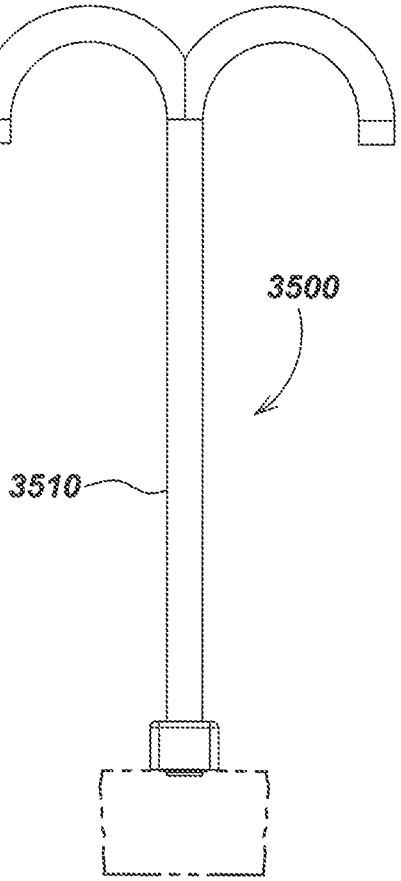
FIG. 35C is a side view of the path light embodiment of FIG. 35A.
Figure 36D:
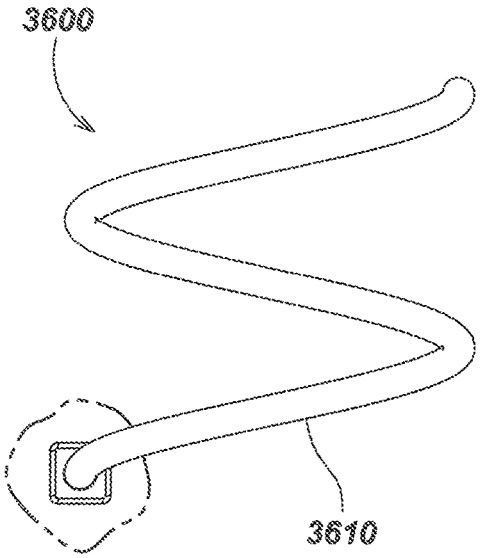
FIG. 36D is a top view of the path light embodiment of FIG. 36A.
Figure 36A:
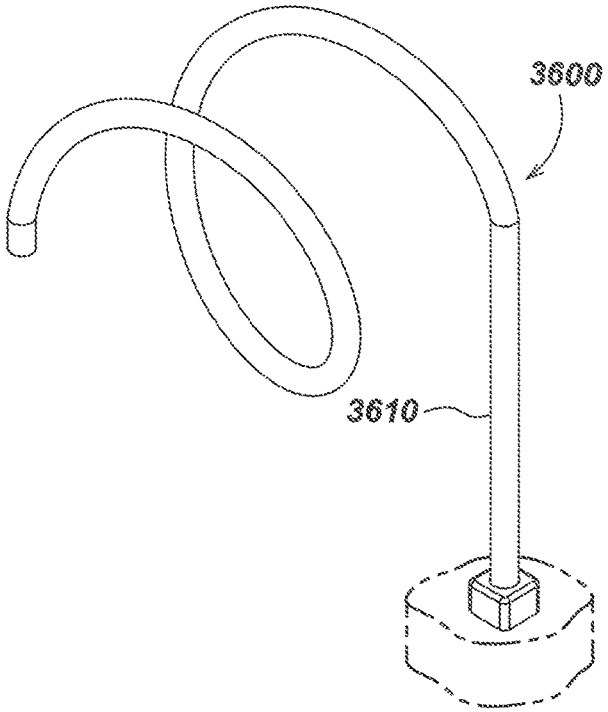
FIG. 36A is an isometric view of a path light embodiment configured with a helix-shaped tubular support.
Figure 36B:
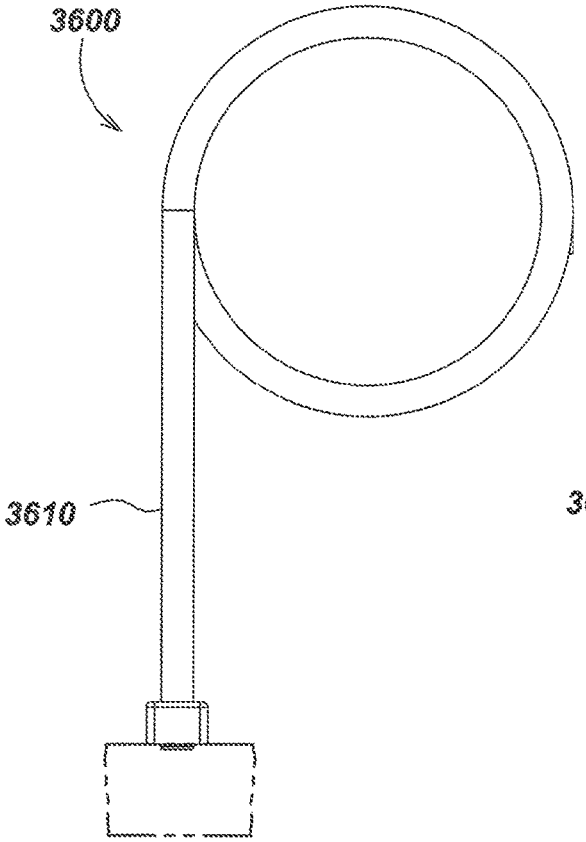
FIG. 36B is a front view of the path light embodiment of FIG. 36A.
Figure 36C:
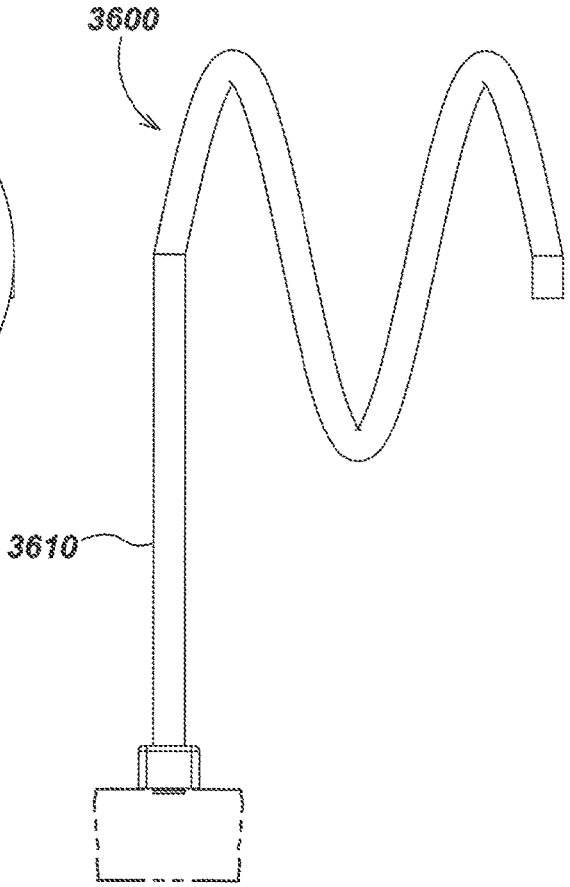
FIG. 36C is a side view of the path light embodiment of FIG. 36A.
Figure 37D:
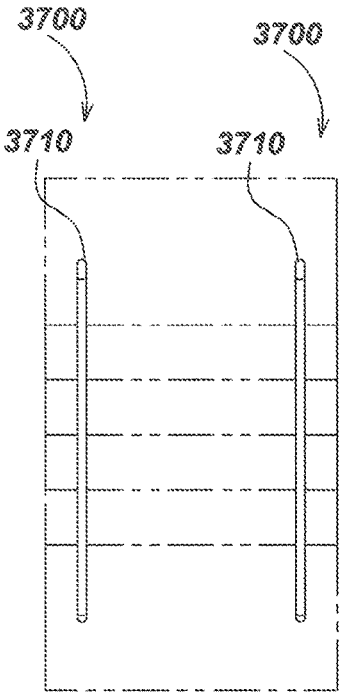
FIG. 37D is a top view of the path light embodiment of FIG. 37A.
Figure 37A:
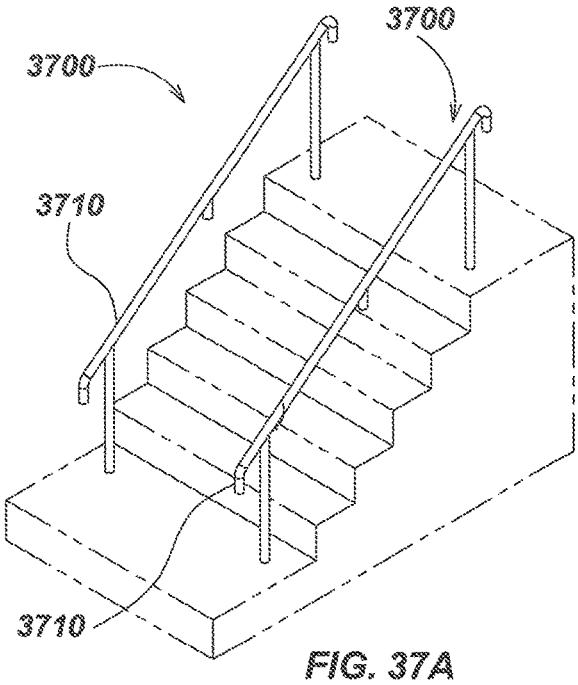
FIG. 37A is an isometric view of a path light embodiment configured in a staircase rail.
Figure 37B:
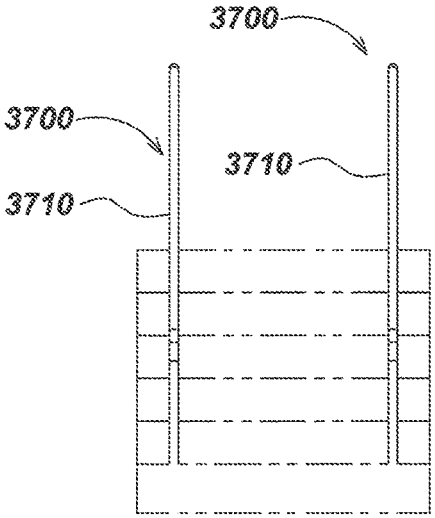
FIG. 37B is a front view of the path light embodiment of FIG. 37A.
Figure 37C:
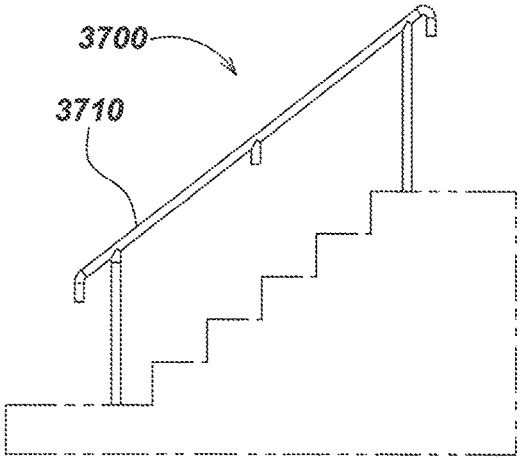
FIG. 37C is a side view of the path light embodiment of FIG. 37A.
Figure 38D:
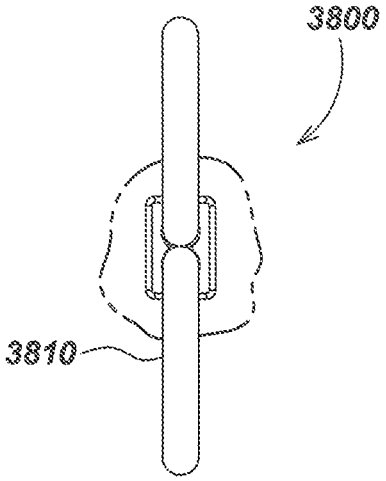
FIG. 38D is a top view of the path light embodiment of FIG. 38A.
Figure 38A:
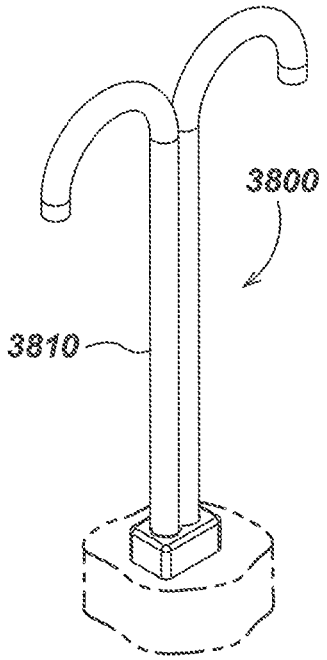
FIG. 38A is an isometric view of a path light embodiment configured with a dual cane tubular support.
Figure 38B:
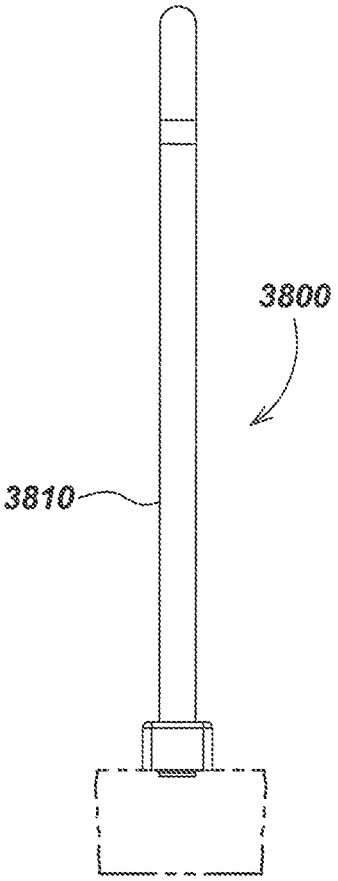
FIG. 38B is a front view of the path light embodiment of FIG. 38A.
Figure 38C:
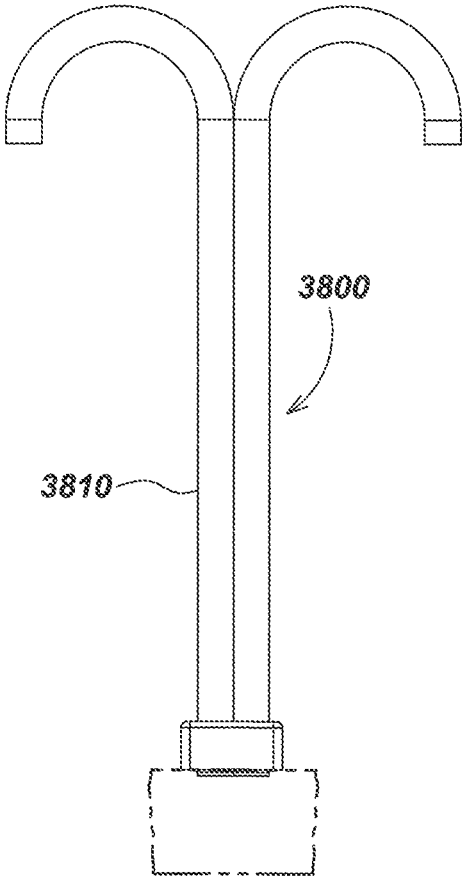
FIG. 38C is a side view of the path light embodiment of FIG. 38A.
Figure 39D:
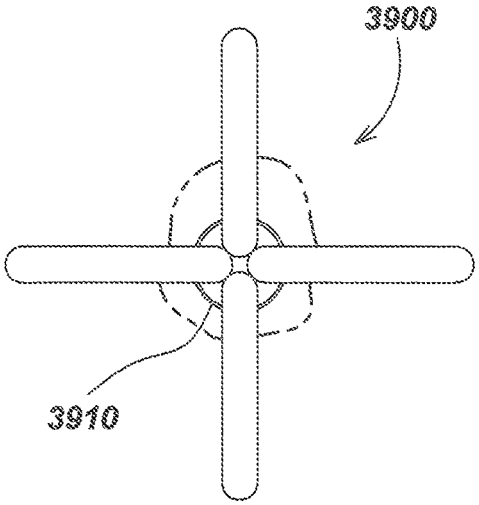
FIG. 39D is a top view of the path light embodiment of FIG. 39A.
Figure 39A:
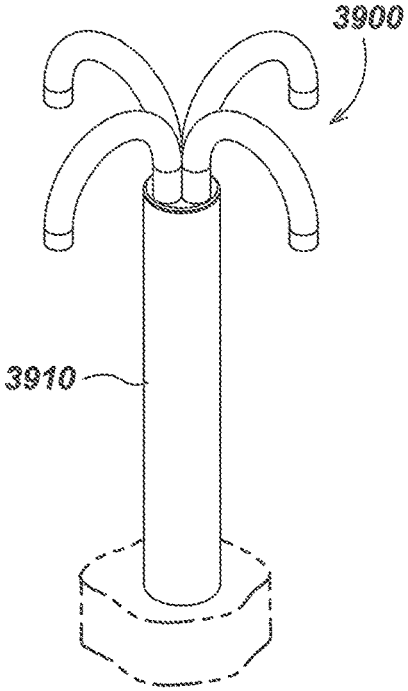
FIG. 39A is an isometric view of a path light embodiment configured with a four-pronged tubular support.
Figure 39B:
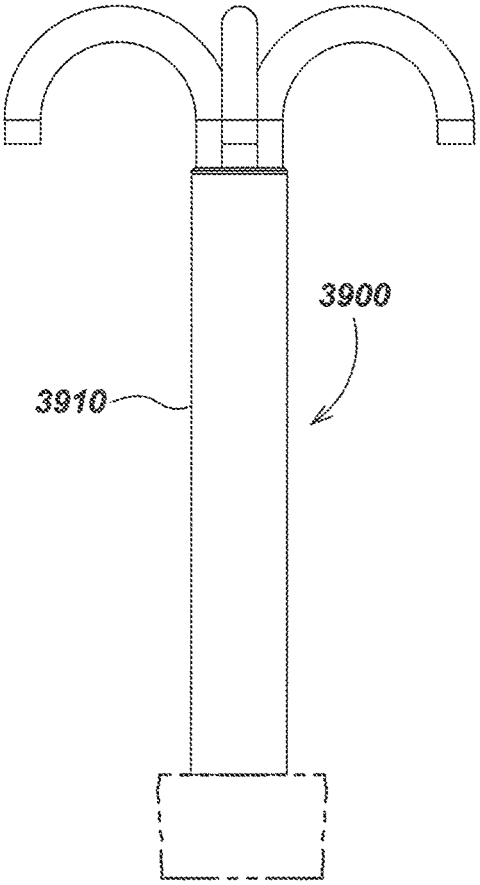
FIG. 39B is a front view of the path light embodiment of FIG. 39A.
Figure 39C:
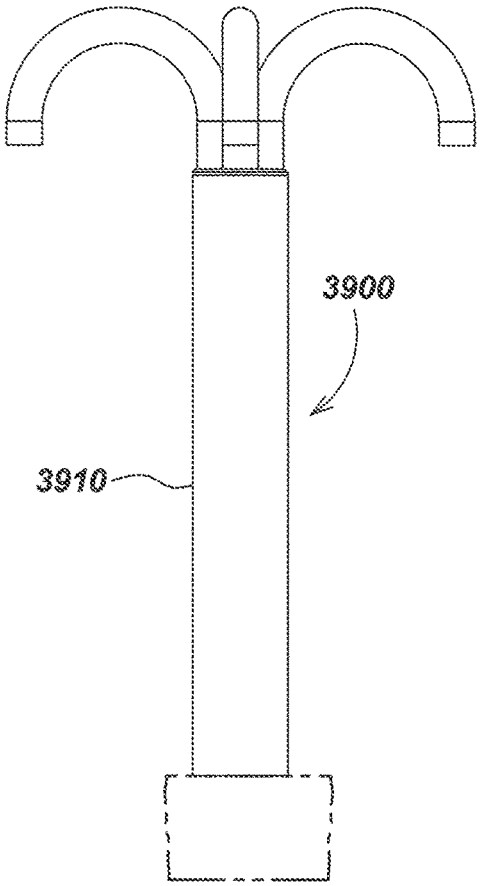
FIG. 39C is a side view of the path light embodiment of FIG. 39A.
Figure 40D:
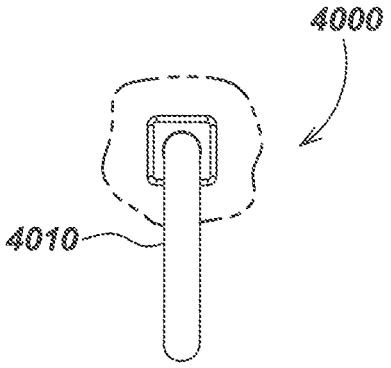
FIG. 40D is a top view of the path light embodiment of FIG. 40A.
Figure 40A:
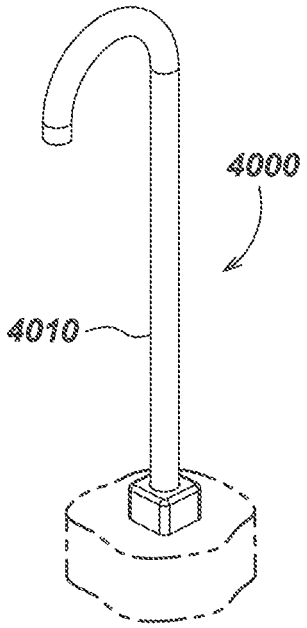
FIG. 40A is an isometric view of a path light embodiment configured with a tall J-shaped tubular support.
Figure 40B:
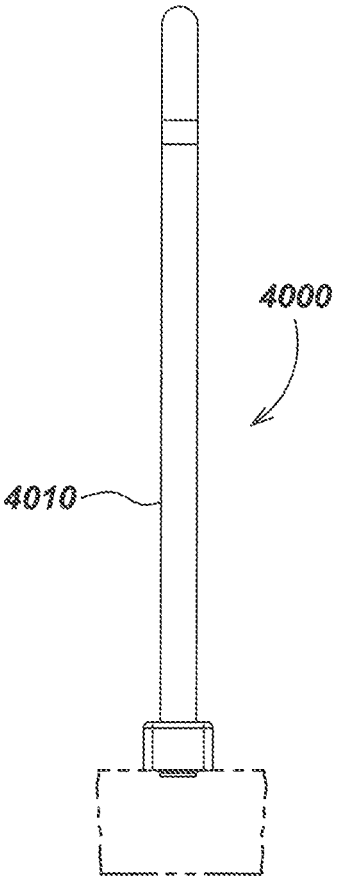
FIG. 40B is a front view of the path light embodiment of FIG. 40A.
Figure 40C:
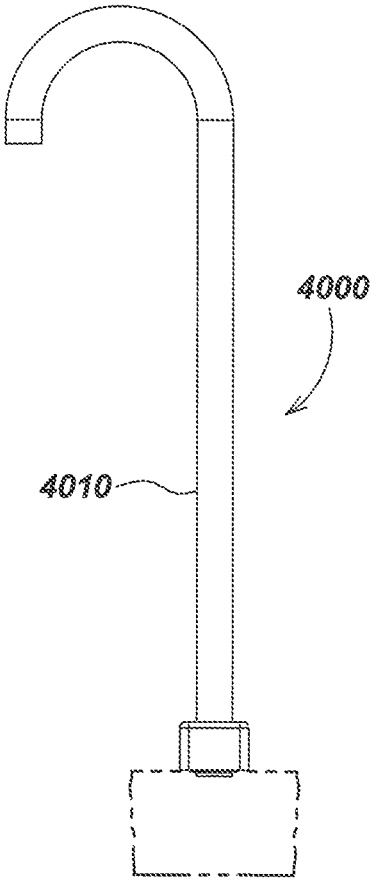
FIG. 40C is a side view of the path light embodiment of FIG. 40A.
Figure 41A:
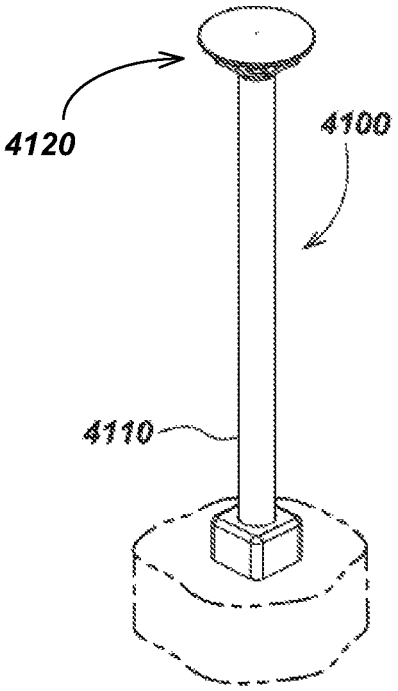
FIG. 41A is an isometric view of a path light embodiment configured with a top mounted reflector element.
Figure 41B:
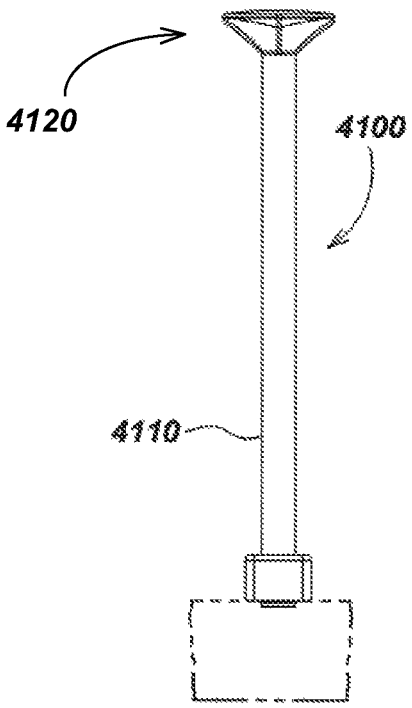
FIG. 41B is a front view of the path light embodiment of FIG. 41A.
Figure 41C:
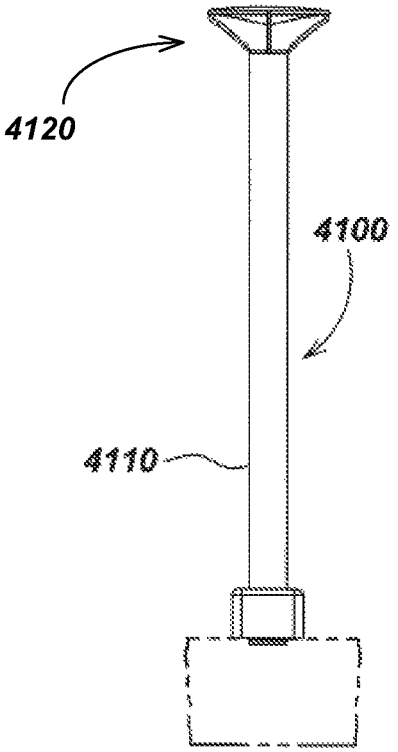
FIG. 41C is a side view of the path light embodiment of FIG. 41A.
Figure 41D:
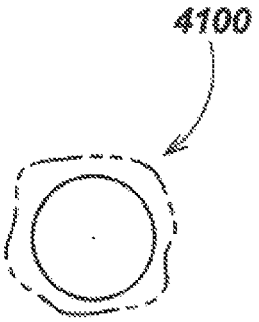
FIG. 41D is a top view of the path light embodiment of FIG. 41A.

Turning to FIG. 19, an exploded view illustrates additional details of the straight-tube path light embodiment 1700 as shown in FIGS. 17 and 18. Light engine 1720 may be disposed within vertical tubular support 1610. Protective cover 1724 may include a circular opening allowing it to fit tightly around vertical tubular support 1610 covering the upper flange plate 1630 with upper top nuts 1632 and upper bottom nuts 1634 securing the upper flange plate 1630 to threaded rods 1618 at the upper ends. Lower flange plate 1644 may be similarly secured to the lower ends of threaded rods 1618 by lower top nuts 1636 and lower bottom nuts 1638, which may form the mounting frame 1650 embedded within poured concrete block 1622 disposed within a cylindrical pour form 1926, which may correspond with cylindrical form 1326 of FIG. 13. The concrete block 1622 within its pour form 1926 would be fixed in position within earth 1905. Wires 1906, which may correspond to 106 of FIGS. 1-2, 806 of FIGS. 8-10, and 1206 of FIG. 12, may be led from light engine 1720 through upper wire conduit 1604 and conduit elbow 1608 prior to the pouring of concrete block 1622.

FIGS. 20A-D through 41A-D illustrate alternate light fixture embodiments of pathway lights. One or more tubular support segments may be dimensioned, shaped, and/or otherwise configured to provide various light fixture ornamental design features as described subsequently herein. For example, the tubular support may be constructed by bending a single length of a tube stock, or by welding two or more tubular support segments to form the path light structural elements into an appropriate shape. In some embodiments, solid segments, rather than tubular segments, may be used, such as to adjust weight, strength, provide alternate appearance or finish, or otherwise vary the appearance or operation of the path light. In addition, modifications to open end segments of the path light embodiments (from which output light is provided) may be done to provide a variety of heights and angles of the output light, which may be directed separately from the specific shape of the path light tubular support elements. Various example embodiments are described subsequently herein.

For example, FIGS. 20A-D illustrate details of an embodiment 2000 of a path light including a short curved tubular support 2010. Alternate embodiments may be configured to direct the light at other angles, such as partially or fully outward, backward, sideways, upward, or downward. The curve segment angle and length may also be varied in some embodiments.

FIGS. 21A-D illustrate details of another embodiment 2100 of a path light including a tall, straight, upward pointing tubular support 2110. Alternate embodiments may be configured to direct the light at other angles than upward, such as partially or fully outward, backward, or sideways.

FIGS. 22A-D illustrate details of another embodiment 2200 of a path light including a short straight tubular support 2210. Alternate embodiments may be configured to direct the light at other angles than upward, such as partially or fully outward, backward, or sideways.

FIGS. 23A-D illustrate details of another embodiment 2300 of a path light including a shallow-angled tubular support 2310. Alternate embodiments may be configured to direct the light at other angles, such as partially or fully outward, backward, or sideways.

FIGS. 24A-D illustrate details of another embodiment 2400 of a path light including a slightly-angled tubular support 2410. Alternate embodiments may be configured to direct the light at other angles, such as partially or fully outward, backward, or sideways.

FIGS. 25A-D illustrate details of another embodiment 2500 of a path light including a moderately-angled tubular support 2510. Alternate embodiments may be configured to direct the light at other angles, such as partially or fully outward, backward, or sideways.

FIGS. 26A-D illustrate details of another embodiment 2600 of a path light including a squared cane tubular support 2610. Alternate embodiments may be configured to direct the light at other angles, such as partially or fully outward, backward, or sideways.

FIGS. 27A-D illustrate details of another embodiment 2700 of a path light including a squared cane tubular support with an angled light outlet 2710.

FIGS. 28A-D illustrate details of another embodiment 2800 of a path light including a curved tubular support with angled light outlet 2810. Alternate embodiments may be configured to direct the light at other angles, such as partially or fully outward, backward, or sideways.

FIGS. 29A-D illustrate details of another embodiment 2900 of a path light including a triangular tubular support 2910. Alternate embodiments may be configured to direct the light at other angles, such as partially or fully outward, backward, or sideways.

FIGS. 30A-D illustrate details of another embodiment 3000 of a path light including a triangular tubular support with a downward angled light outlet 3010. Alternate embodiments may be configured to direct the light at other angles, such as partially or fully outward, backward, or sideways.

FIGS. 31A-D illustrate details of another embodiment 3100 of a path light including a triangular tubular support with an angled light outlet 3110. Alternate embodiments may be configured to direct the light at other angles, such as partially or fully outward, backward, or sideways.

FIGS. 32A-D illustrate details of another embodiment 3200 of a path light including a T-shaped tubular support 3210. Alternate embodiments may include one or more additional T-shaped tubular support element in a similar configuration.

FIGS. 33A-D illustrate details of another embodiment 3300 of a path light including an arched segment coupled to a J-shaped tubular support 3310. Alternate embodiments may include additional arched and/or J-shaped support segments in a similar configuration.

FIGS. 34A-D illustrate details of another embodiment 3400 of a path light including an angled segment coupled to a single J-shaped tubular support 3410. Alternate embodiments may include additional angled and/or J-shaped support segments in a similar configuration.

FIGS. 35A-D illustrate details of another embodiment 3500 of a path light including a tubular support with two symmetrical arched segments 3510. Alternate embodiments may include three or more symmetrical arched segments in a similar configuration.

FIGS. 36A-D illustrate details of another embodiment 3600 of a path light including a helix-shaped tubular support 3610. Alternate embodiments may include fewer or more turns in the helix, and the turns may be of varying diameters, cross-sectional areas, and/or may have a light output end directing light in other directions, such as fully or partially upward, to the side, backward, or forward.

FIGS. 37A-D illustrate details of another embodiment 3700 of a path light in the form of a tubular support staircase railing 3710 with downward directed lighting segments. Staircase rail embodiment 3700 as shown includes three downward directed lighting segments (one at the end of each rail and one in the middle), however, in alternate embodiments, there may be fewer or more lighting segments, which may also be directed in other directions and/or angles, such as fully or partially outward or inward, fully or partially upward, or directed at other objects or structures.

FIGS. 38A-D illustrate details of another embodiment 3800 of a path light including a dual J-shaped tubular support 3810. Alternate embodiments may include three or more J-shaped tubular support elements in a similar configuration.

FIGS. 39A-D illustrate details of another embodiment 3900 of a path light including a four-pronged tubular support 3910. Alternate embodiments may include three prongs or five or more prongs in a similar configuration.

FIGS. 40A-D illustrate details of another embodiment 4000 of a path light including a J-shaped tubular support 4010, which may include one or more tubular segments.

FIGS. 41A-D illustrate details of another embodiment 4100 of a path light including a vertical tubular support 4100 with a top-mounted reflector element 4120.

The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The disclosure is not intended to be limited to the aspects shown and described herein, but should be accorded the full scope consistent with the specification and drawings, wherein reference to an element in the singular is not intended to mean "one and only one" unless specifically so stated, but rather "one or more". Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c.

The previous description of the disclosed aspects is provided to enable any person skilled in the art to make or use the present disclosure. Various modifications to these aspects will be readily apparent to those skilled in the art, and the generic principles defined herein may be applied to other aspects without departing from the spirit or scope of the disclosure. Thus, the invention is not intended to be limited to the aspects shown and described herein but is to be accorded the widest scope consistent with the following claims and their equivalents.

We claim:

1. A pathway lighting apparatus, comprising:

a tubular element including a curved top portion having a downward facing end, the downward facing end having an opening or cavity;

a mounting flange element coupled to the tubular element;

a light engine removably mounted to the curved top portion of the tubular element; and a removable locking mechanism to removably mount the light engine to the curved top portion of the tubular element;

wherein the light engine includes one or more lighting elements disposed in the opening formed in the downward facing end to direct light emitted by the lighting elements through the opening in a downward and outward direction to illuminate a pathway, the locking mechanism includes a light fixture body, a threaded adjustment element, and a contact element, and the threaded adjustment element includes threaded cylinder elements configured to move within a threaded channel of the light fixture body to position the contact element against the light fixture body.

2. The lighting apparatus of claim 1, wherein the light fixture body includes a shaped cavity having a gap for allowing the contact element to apply contact pressure to the light fixture body.

3. The lighting apparatus of claim 2, wherein the contact element includes one or more ball bearings sized to mate with the shaped cavity of the light fixture body.

4. The lighting apparatus of claim 1, wherein the threaded cylinder elements are set screws.

5. The lighting apparatus of claim 1, further comprising a driver module coupled to the light engine to provide power to the one or more lighting elements from a coupled power supply system.

6. The lighting apparatus of claim 1, wherein the light fixture body is configured to provide a direct thermal path between the light engine and the tubular element to dissipate heat generated by the one or more lighting elements.

7. The lighting apparatus of claim 1, wherein the light engine comprises a metal core printed circuit board having the one or more lighting elements disposed thereon.

* * * * *